US009708738B2

(12) United States Patent
Kawaguchi et al.

(10) Patent No.: US 9,708,738 B2
(45) Date of Patent: Jul. 18, 2017

(54) EMBROIDERY FRAME AND SEWING MACHINE

(71) Applicant: BROTHER KOGYO KABUSHIKI KAISHA, Nagoya-shi, Aichi-ken (JP)

(72) Inventors: Yasuhiko Kawaguchi, Nagoya (JP); Takahira Osamura, Kitanagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 541 days.

(21) Appl. No.: 14/307,771

(22) Filed: Jun. 18, 2014

(65) Prior Publication Data

US 2015/0000574 A1 Jan. 1, 2015

(30) Foreign Application Priority Data

Jun. 27, 2013 (JP) ..... 2013-134561

(51) Int. Cl.
*D05C 9/06* (2006.01)
*D05C 9/04* (2006.01)

(52) U.S. Cl.
CPC *D05C 9/06* (2013.01); *D05C 9/04* (2013.01)

(58) Field of Classification Search
CPC ..... D05C 9/04; D05C 9/06
USPC ..... 112/103
See application file for complete search history.

(56) References Cited

U.S. PATENT DOCUMENTS 3,405,670 A * 10/1968 Scholl ..... D05B 39/00 112/102
4,587,910 A 5/1986 Raines
4,706,583 A 11/1987 Darbenzio
4,767,111 A 8/1988 Guenther
4,870,917 A 10/1989 Frye
4,981,092 A * 1/1991 Bauman ..... D05C 9/04 112/102
5,237,941 A 8/1993 Kraft et al.
5,353,725 A 10/1994 Sakakibara
5,427,043 A * 6/1995 Conley, Jr. ..... D05B 39/00 112/102.5

(Continued)

FOREIGN PATENT DOCUMENTS

EP 1 862 574 A1 12/2007
GB 2125073 A 2/1984

(Continued)

OTHER PUBLICATIONS

Apr. 28, 2015 Office Action issued in U.S. Appl. No. 14/307,969.

(Continued)

*Primary Examiner* — Danny Worrell
(74) *Attorney, Agent, or Firm* — Oliff PLC

(57) ABSTRACT

An embroidery frame includes a lower holding member, an upper holding member, and a first adjustment mechanism. The lower holding member is configured such that a sewing workpiece is placed on the lower holding member. The upper holding member is configured to press from above on the sewing workpiece that is placed on the lower holding member. The first adjustment mechanism is configured to adjust a distance between the lower holding member and the upper holding member in a state in which the upper holding member is pressing from above on the sewing workpiece that is placed on the lower holding member.

24 Claims, 22 Drawing Sheets

(56) References Cited

U.S. PATENT DOCUMENTS

| | | | | |
|---|---|---|---|---|
| 5,590,613 | A * | 1/1997 | Head | D05C 9/04 112/103 |
| 5,664,350 | A * | 9/1997 | Moore, III | D05C 1/02 38/102.2 |
| 5,860,375 | A * | 1/1999 | Williams | D05C 1/02 112/103 |
| 5,899,155 | A | 5/1999 | Thoren | |
| 6,138,592 | A | 10/2000 | Seneff | |
| 6,336,416 | B1 | 1/2002 | French et al. | |
| 6,679,190 | B1 | 1/2004 | French et al. | |
| 7,100,523 | B2 * | 9/2006 | Terao | D05C 9/04 112/103 |
| 7,290,492 | B2 * | 11/2007 | Watanabe | D05C 9/04 112/103 |
| 7,377,222 | B1 * | 5/2008 | Moore, III | D05B 35/04 112/103 |
| 7,584,708 | B1 * | 9/2009 | Viltrakis | D05C 9/04 112/103 |
| 7,966,957 | B2 * | 6/2011 | Mack | D05C 9/04 112/103 |
| 9,032,887 | B2 * | 5/2015 | Viltrakis | D05C 9/04 112/103 |
| 9,163,344 | B2 * | 10/2015 | Kawaguchi | D05B 19/08 |
| 9,194,070 | B2 * | 11/2015 | Kawaguchi | D05C 9/06 |
| 2002/0092212 | A1 * | 7/2002 | Kessler | D05B 3/06 38/102.2 |
| 2003/0197772 | A1 | 10/2003 | Iwatsuki et al. | |
| 2004/0221780 | A1 | 11/2004 | Kawaguchi et al. | |
| 2007/0079741 | A1 | 4/2007 | Watanabe et al. | |
| 2007/0277715 | A1 | 12/2007 | Watanabe | |
| 2011/0315059 | A1 | 12/2011 | Lee et al. | |
| 2015/0000574 | A1 * | 1/2015 | Kawaguchi | D05C 9/04 112/103 |
| 2015/0259841 | A1 * | 9/2015 | Ihira | D05C 5/04 112/102.5 |

FOREIGN PATENT DOCUMENTS

| | | | |
|---|---|---|---|
| JP | 01260052 | A | 10/1989 |
| JP | A-11-151391 | | 6/1999 |
| JP | A-2001-212390 | | 8/2001 |
| JP | 2003-312069 | A | 11/2003 |
| JP | A-2004-254987 | | 9/2004 |
| JP | A-2005-334030 | | 12/2005 |
| JP | A-2007-105138 | | 4/2007 |
| JP | 2007-319509 | A | 12/2007 |
| JP | 2013-078474 | A | 5/2013 |
| WO | WO 94/13874 | | 6/1994 |

OTHER PUBLICATIONS

Nov. 16, 2015 Office Action issued in European Patent Application No. 141737742.

Nov. 16, 2015 Office Action issued in European Patent Application No. 14173775.9.

Oct. 9, 2014 extended European Search Report issued in European Patent Application No. EP 14173774.2.

Oct. 9, 2014 extended European Search Report issued in European Patent Application No. EP 14173775.9.

U.S. Appl. No. 14/307,969, filed Jun. 18, 2014.

Feb. 21, 2017 Office Action issued in Japanese Patent Application No. 2013-134561.

* cited by examiner

EMBROIDERY FRAME AND SEWING MACHINE

CROSS-REFERENCE TO RELATED APPLICATION

This application claims priority to Japanese Patent Application No. 2013-134561, filed on Jun. 27, 2013, the content of which is hereby incorporated herein by reference.

BACKGROUND

The present disclosure relates to an embroidery frame and to a sewing machine in which the embroidery frame can be mounted.

A sewing machine is known that can perform embroidery sewing on a sewing workpiece that is held in an embroidery frame. The embroidery frame, which is provided with an upper frame and a lower frame, can be mounted in the sewing machine. The upper frame of the embroidery frame is connected to the lower frame by a connecting member, such that the upper frame is able to pivot up and down on the lower frame.

SUMMARY

The upper frame and the lower frame of the embroidery frame that is described above are formed as substantially flat plates on the assumption that they will hold a sewing workpiece of uniform thickness. It is therefore difficult for the embroidery frame to reliably hold a sewing workpiece whose thickness is not uniform.

Various embodiments of the broad principles derived herein provide an embroidery frame and a sewing machine, the embroidery frame being capable of reliably holding even a sewing workpiece whose thickness is not uniform.

Embodiments provide an embroidery frame that includes a lower holding member, an upper holding member, and a first adjustment mechanism. The lower holding member is configured such that a sewing workpiece is placed on the lower holding member. The upper holding member is configured to press from above on the sewing workpiece that is placed on the lower holding member. The first adjustment mechanism is configured to adjust a distance between the lower holding member and the upper holding member in a state in which the upper holding member is pressing from above on the sewing workpiece that is placed on the lower holding member.

Embodiments also provide a sewing machine that includes an embroidery frame. The embroidery frame includes a lower holding member, an upper holding member, and a first adjustment mechanism. The lower holding member is configured such that a sewing workpiece is placed on the lower holding member. The upper holding member is configured to press from above on the sewing workpiece that is placed on the lower holding member. The first adjustment mechanism is configured to adjust a distance between the lower holding member and the upper holding member in a state in which the upper holding member is pressing from above on the sewing workpiece that is placed on the lower holding member.

BRIEF DESCRIPTION OF THE DRAWINGS

Embodiments will be described below in detail with reference to the accompanying drawings in which.

DETAILED DESCRIPTION

Figure 7:
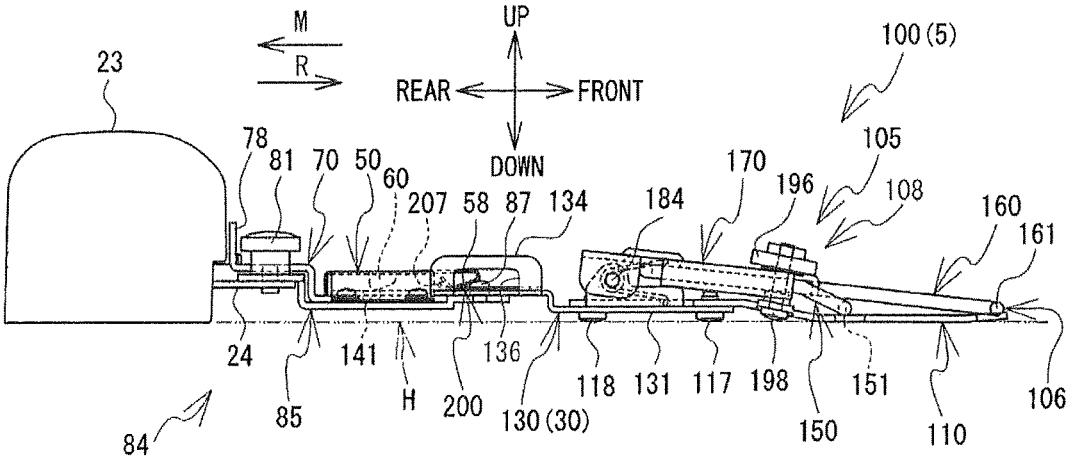
FIG. 7 is a left side view of the embroidery frame 100 and the frame support mechanism 84 in a case where a pressing portion 151 of a first pressing member 150 and a pressing portion 161 of a second pressing member 160 are in contact with a lower holding member 110.
Figure 8:
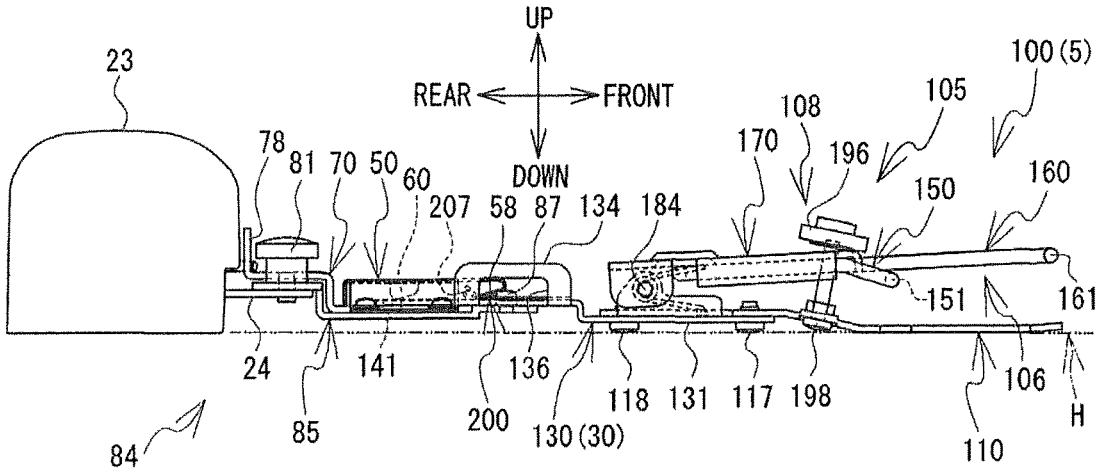
FIG. 8 is a left side view of the embroidery frame 100 and the frame support mechanism 84 in a case where the pressing portion 151 of the first pressing member 150 and the pressing portion 161 of the second pressing member 160 have moved away from the lower holding member 110.
Figure 9:
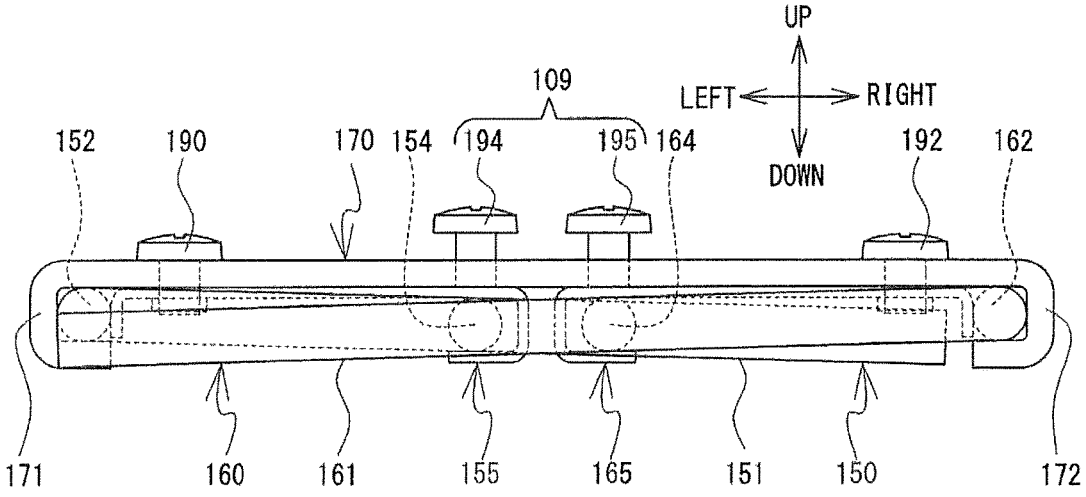
FIG. 9 is a front view that schematically shows positions of the pressing portion 151 of the first pressing member 150 and the pressing portion 161 of the second pressing member 160 in an up-down direction (an extension direction) in a case where screws 194 and 195 are in initial positions.
Figure 10:
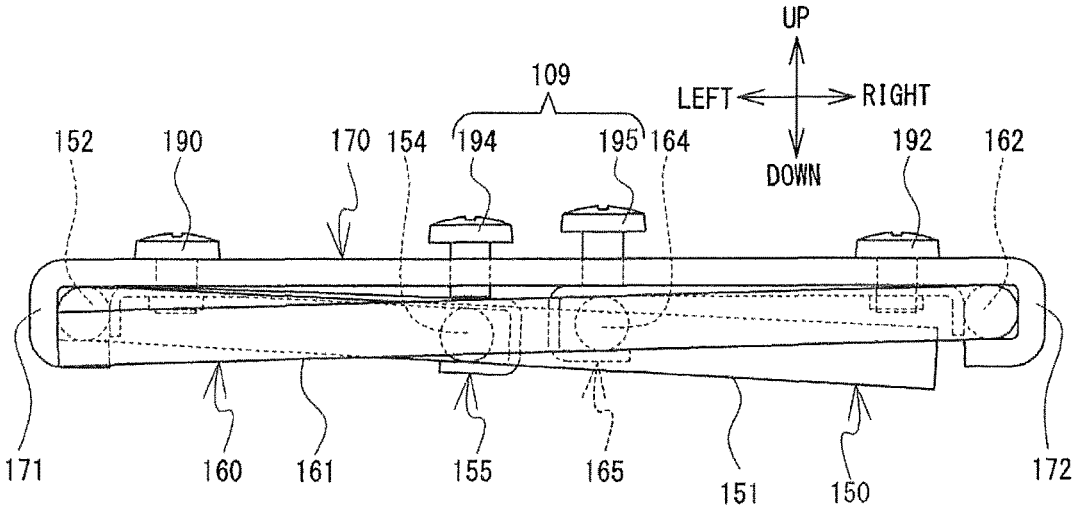
FIG. 10 is a front view that schematically shows the positions of the pressing portion 151 of the first pressing member 150 and the pressing portion 161 of the second pressing member 160 in the up-down direction (the extension direction) in a case where the screw 194 has been tightened from its initial position.
Figure 11:
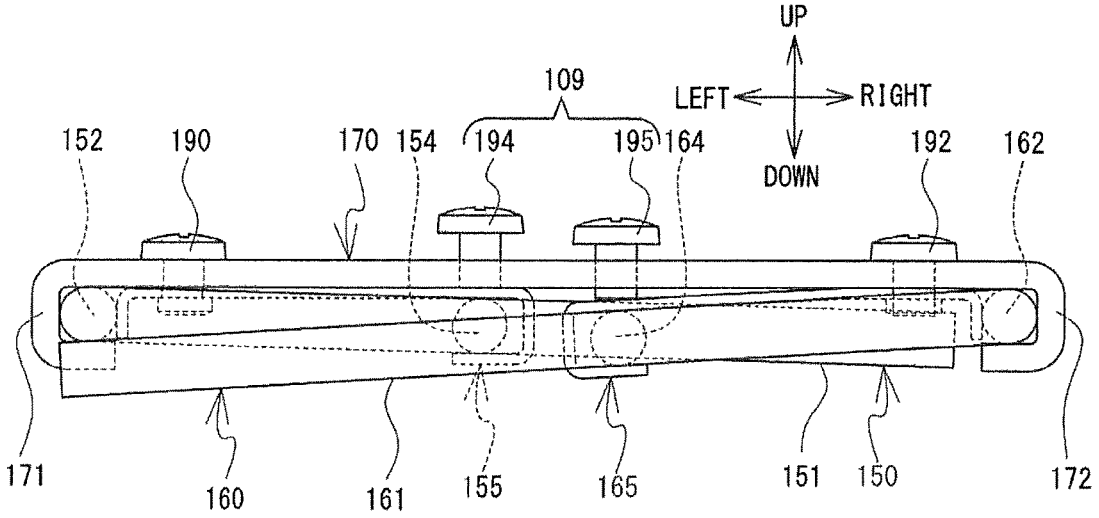
FIG. 11 is a front view that schematically shows the positions of the pressing portion 151 of the first pressing member 150 and the pressing portion 161 of the second pressing member 160 in the up-down direction (the extension direction) in a case where the screw 195 has been tightened from its initial position.

Hereinafter, an embodiment of the present disclosure will be explained with reference to the drawings. Note that the drawings are used for explaining technological features that the present disclosure can utilize. Accordingly, device configurations, flowcharts for various types of processing, and the like that are shown in the drawings are merely explanatory examples and do not serve to restrict the present disclosure to those configurations, flowcharts, and the like, unless otherwise indicated specifically. First, a configuration of a multi-needle sewing machine (hereinafter simply called the sewing machine) 1 according to the embodiment will be explained with reference to FIGS. 1 to 9. In the explanation that follows, the top side, the bottom side, the lower left side, the upper right side, the upper left side, and the lower right side in FIG. 1 indicate the top side, the bottom side, the front side, the rear side, the left side, and the right side of the sewing machine 1. In FIGS. 7, 8, 16, and 19, representations of screws 190, 191, 194 have been omitted. In FIGS. 9 to 11, representations of a first adjustment member 108 and of a front edge portion 187 of a support member 170 have been omitted.

Figure 1:
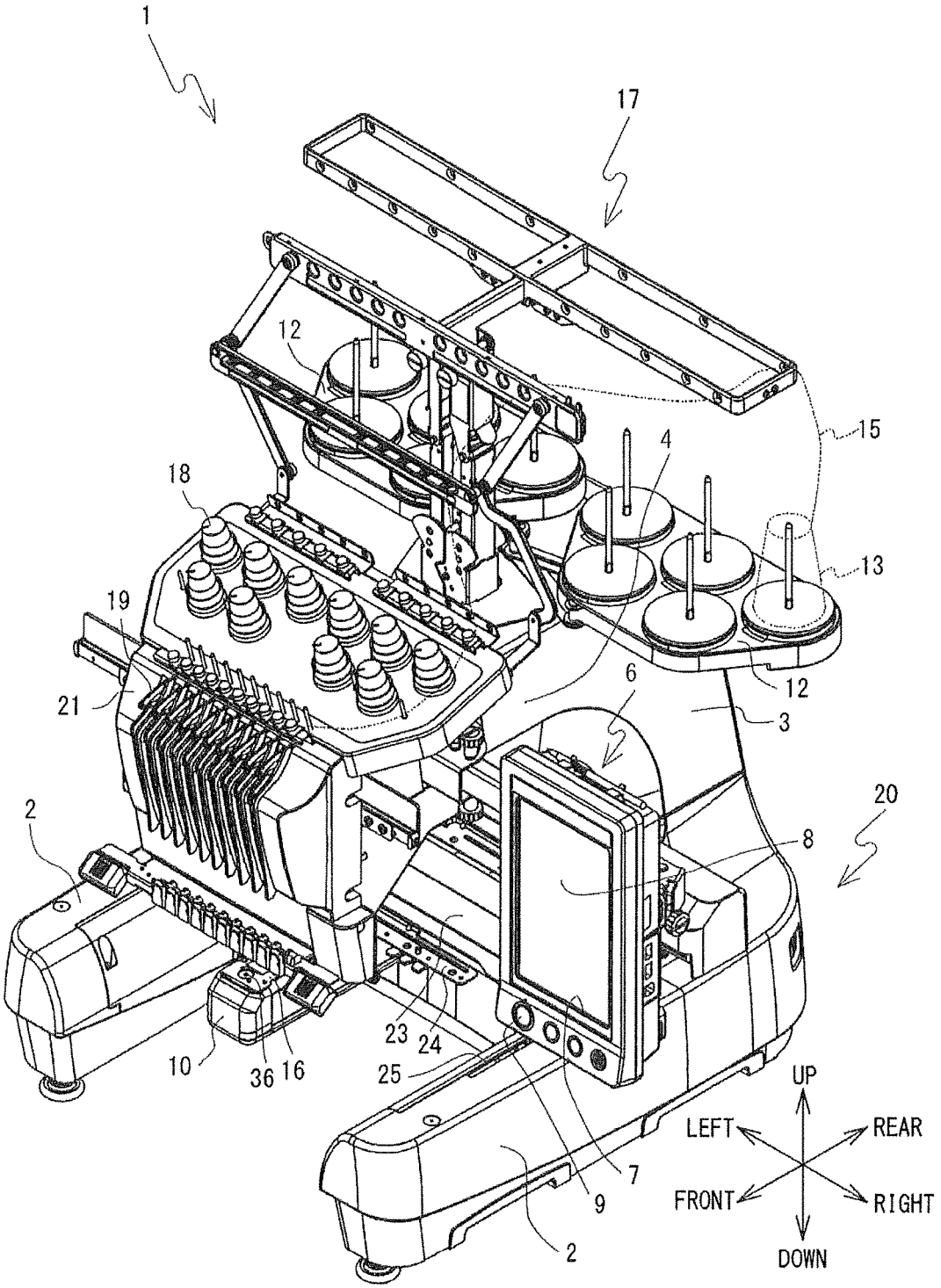
FIG. 1 is an oblique view of a multi-needle sewing machine 1.

As shown in FIG. 1, a body 20 of the sewing machine 1 is mainly provided with a left-right pair of support portions 2, a pillar 3, and an arm 4. The left-right pair of the support portions 2 are formed into an inverted U shape when viewed as a whole in a plan view, constitute a base portion of the sewing machine 1, and support the entire sewing machine 1. A left-right pair of guide slots 25 that extend in the front-rear direction are formed in the top faces of the support portions 2 (the guide slot 25 on the left side not being shown in the drawings). The pillar 3 is provided such that it extends upward from the rear edges of the support portions 2. The arm 4 extends toward the front from the top end of the pillar 3. A needle bar case 21 is mounted on the front end of the arm 4 such that it can move to the left and the right. In the interior of the needle bar case 21, ten needle bars (not shown in the drawings) that extend in the up-down direction are arrayed at equal intervals in the left-right direction. The one of the ten needle bars that is in a sewing position is made to slide up and down by a needle bar drive mechanism (not shown in the drawings) that is provided in the interior of the needle bar case 21. Sewing needles (not shown in the drawings) can be mounted on and removed from the lower ends of the needle bars (not shown in the drawings).

An operation portion 6 is provided on the right side of the arm 4, midway between the front and the rear. The operation portion 6 is provided with a liquid crystal display (hereinafter called the LCD) 7, a touch panel 8, and a start/stop switch 9. Various types of information, such as an operation image or the like for a user to input commands, are displayed on the LCD 7. The touch panel 8 is used to accept commands from the user. By using a finger or a touch pen to perform operations of pressing locations on the touch panel 8 that correspond to the positions of the input keys or the like that are displayed on the LCD 7, the user is able to select and set a pattern to be sewn, as well as various types of conditions such as sewing conditions and the like. The start/stop switch 9 is a switch for commanding the sewing machine 1 to start and stop the sewing.

A cylindrical cylinder bed 10 that extends toward the front from the bottom end of the pillar 3 is provided underneath the arm 4. A shuttle (not shown in the drawings) is provided in the interior of the front end of the cylinder bed 10. The shuttle contains a bobbin (not shown in the drawings) around which a lower thread (not shown in the drawings) is wound. A shuttle drive mechanism (not shown in the drawings) is provided in the interior of the cylinder bed 10. The shuttle drive mechanism is configured such that it drives the shuttle rotationally. A needle plate 16 that is rectangular in a plan view is provided on the top face of the cylinder bed 10. A needle hole 36 through which a sewing needle (not shown in the drawings) passes is provided in the needle plate 16.

A left-right pair of thread spool holders 12 are provided on the rear side of the top face of the arm 4. Ten thread spools 13, the same number as the number of the needle bars, can be disposed on the pair of the thread spool holders 12. Upper threads 15 are supplied from the thread spools 13 that are disposed on the thread spool holders 12. Each of the upper threads 15 is supplied through a thread guide 17, a tensioner 18, a thread take-up lever 19, and the like to an eye of one of the sewing needles that are mounted on the lower ends of the needle bars that are not shown in the drawings.

Below the arm 4, a Y carriage 23 is supported such that it can move toward the front and the rear (parallel to a Y axis) in relation to the sewing machine 1. The Y carriage 23 extends in the left-right direction. As shown schematically in FIG. 2, the Y carriage 23 supports an X carriage 26 in its interior such that the X carriage 26 can move to the left and the right (parallel to an X axis) in relation to the sewing machine 1. A holder 24 for mounting an embroidery frame 5 is attached to the X carriage 26. The sewing machine 1 is configured such that the X carriage 26 is conveyed to the left and the right, using an X axis motor (not shown in the drawings) as a drive source, and the Y carriage 23 is conveyed toward the front and the rear, using a Y axis motor (not shown in the drawings) as a drive source. The sewing machine 1 conveys the embroidery frame 5, which is mounted in the sewing machine 1 through the holder 24, to a needle drop point that is indicated in an embroidery coordinate system that is specific to the sewing machine 1. The embroidery coordinate system is the coordinate system for the X axis motor that conveys the X carriage 26 and for the Y axis motor. The needle drop point is the point where the sewing needle that is positioned directly above the needle hole 36 will pierce the sewing workpiece when the needle bar that holds the sewing needle moves downward from above the sewing workpiece.

Figure 2:
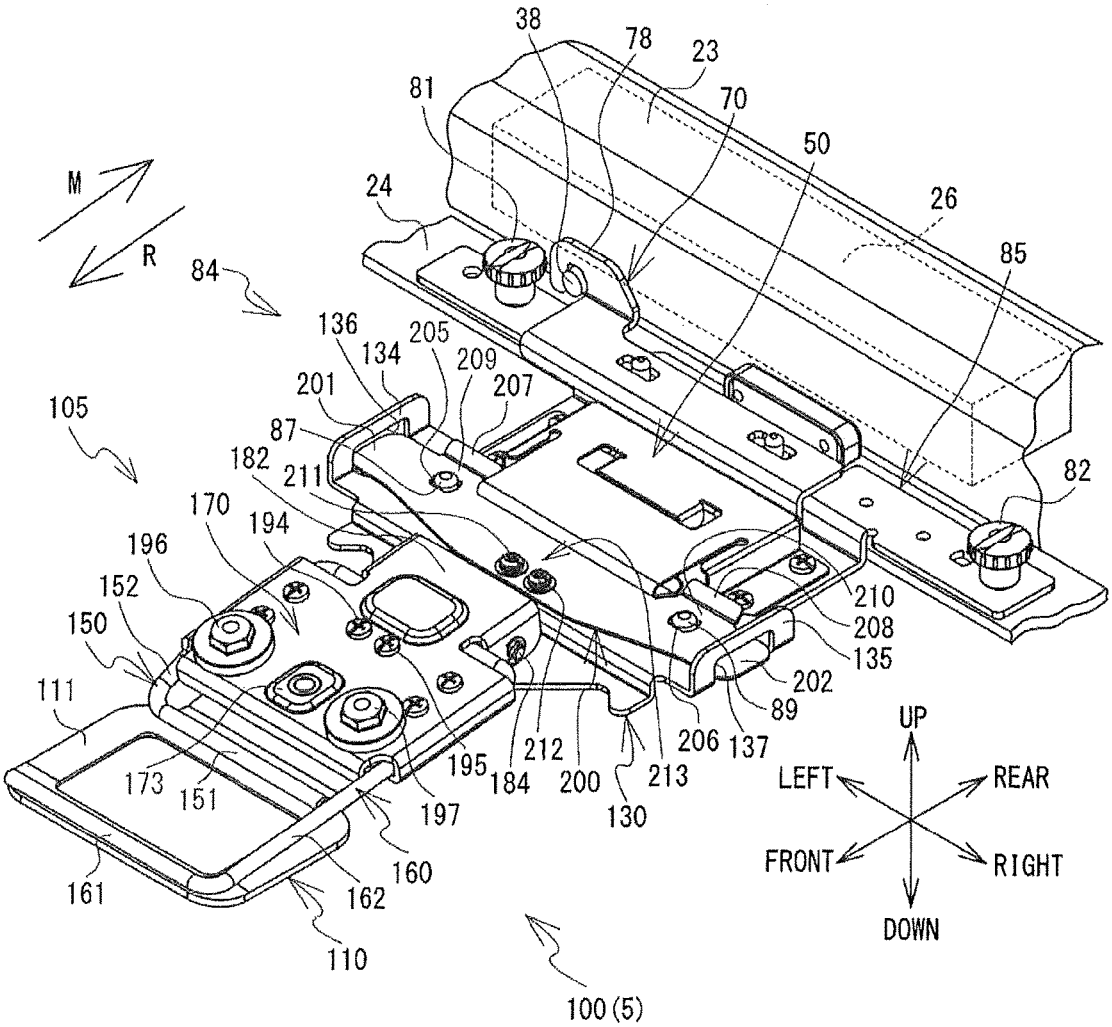
FIG. 2 is an oblique view of an embroidery frame 100 and a frame support mechanism 84 on which the embroidery frame 100 is mounted.
Figure 3:
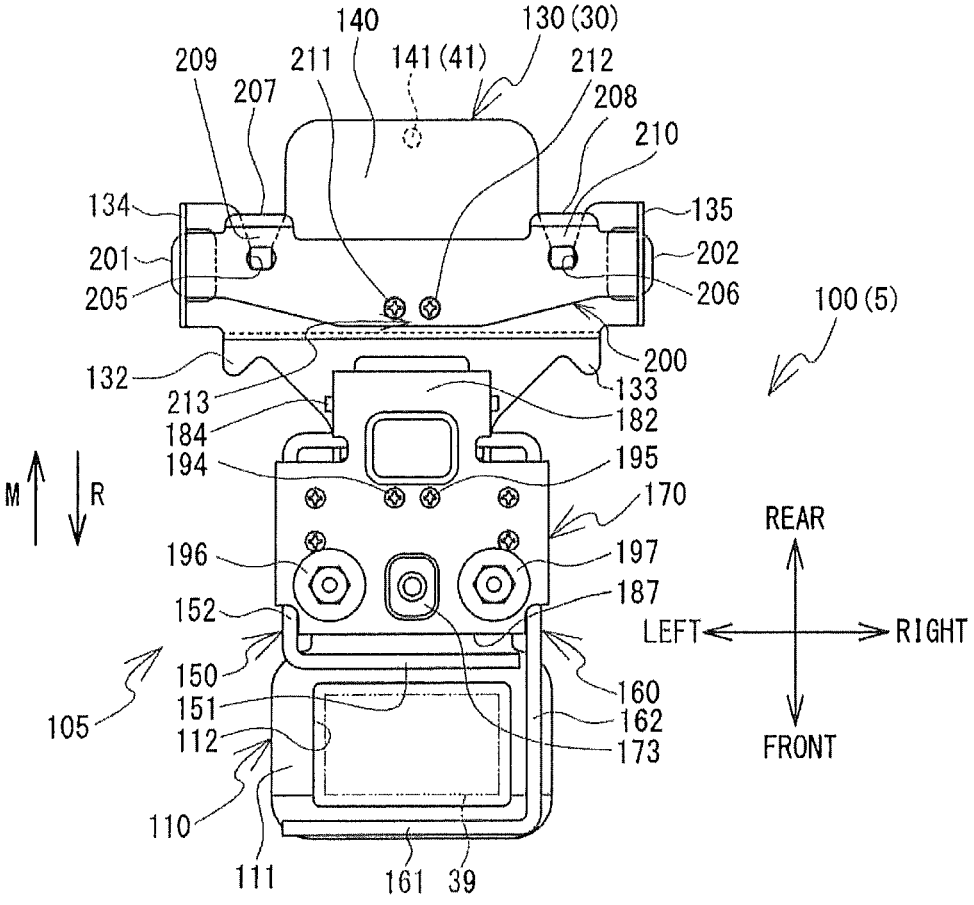
FIG. 3 is a plan view of the embroidery frame 100, which can be mounted in the multi-needle sewing machine 1.
Figure 4:
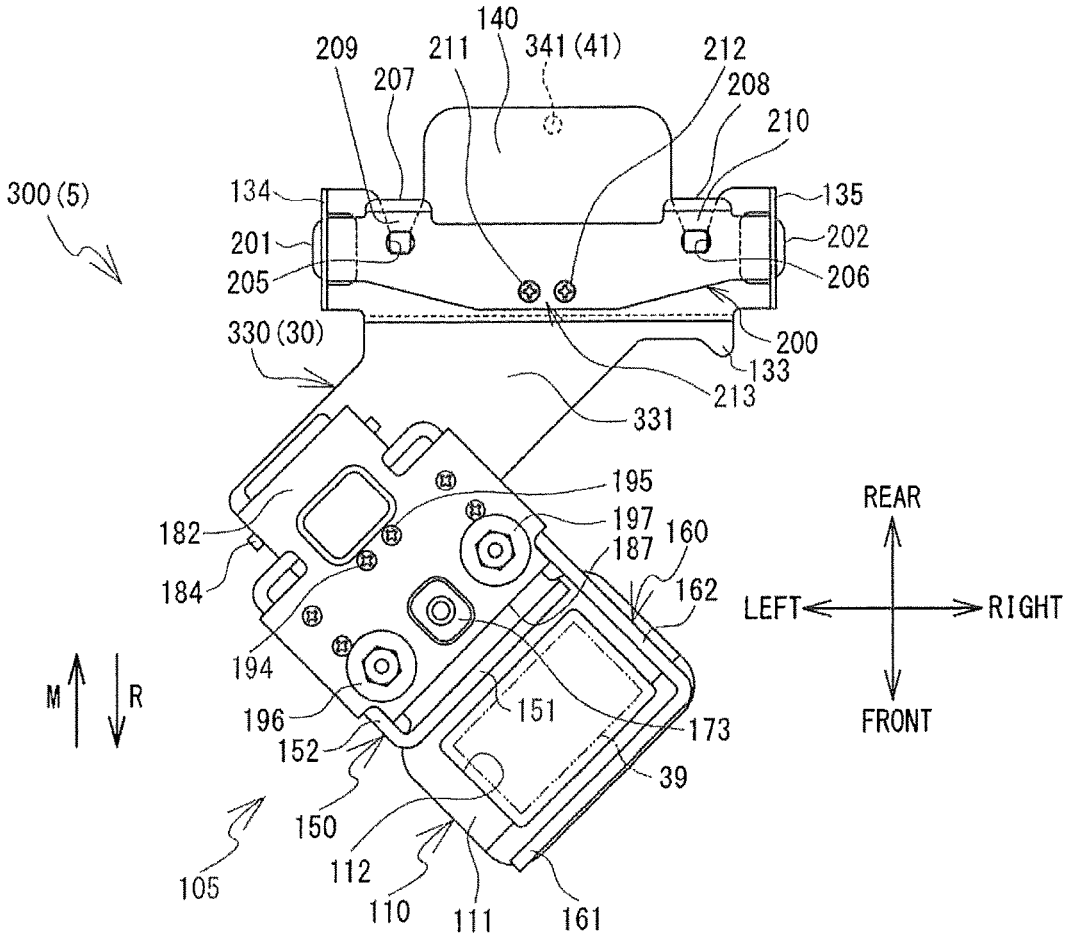
FIG. 4 is a plan view of an embroidery frame 300 that can be mounted in the multi-needle sewing machine 1.
Figure 5:
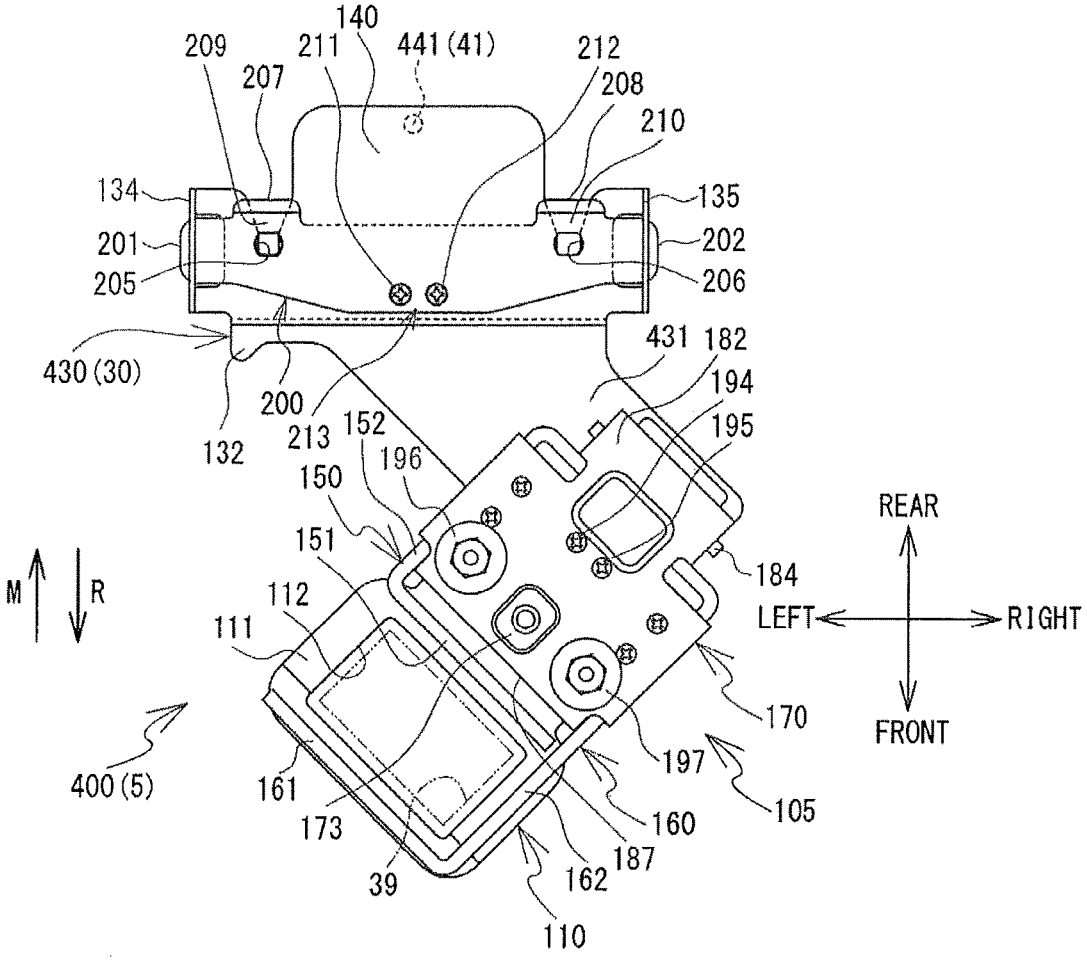
FIG. 5 is a plan view of an embroidery frame 400 that can be mounted in the multi-needle sewing machine 1.

The embroidery frame 5 will be explained with reference to FIGS. 2 to 13. The embroidery frame 5 is able to hold the sewing workpiece (for example, a work cloth or a shoe). In the present embodiment, three alternative types of the embroidery frame 5 can be mounted in the sewing machine 1. The three types of the embroidery frame 5 are an embroidery frame 100 that is shown in FIGS. 2 and 3, an embroidery frame 300 that is shown in FIG. 4, and an embroidery frame 400 that is shown in FIG. 5. In the present embodiment, in a case where the embroidery frames 100, 300, 400 are referenced collectively, they will be called the embroidery frames 5, and in a case where a particular embroidery frame is not specified, it will be called the embroidery frame 5. In the present embodiment, each one of the three types of the embroidery frame 5 is provided with a holding member 105. A sewable area 39 is provided in each one of the three types of the embroidery frame 5, and the angle of a long axis of the sewable area 39 in relation to the direction (the left-right direction) in which the Y carriage 23 extends varies according to the type of the embroidery frame 5. The sewable area 39 is an area in which a stitch that is set by the sewing machine 1 can be formed. The configurations of the embroidery frames 5 in the states in which they are mounted in the sewing machine 1 will be explained for the embroidery frame 100, 300, 400 in that order.

Figure 6:
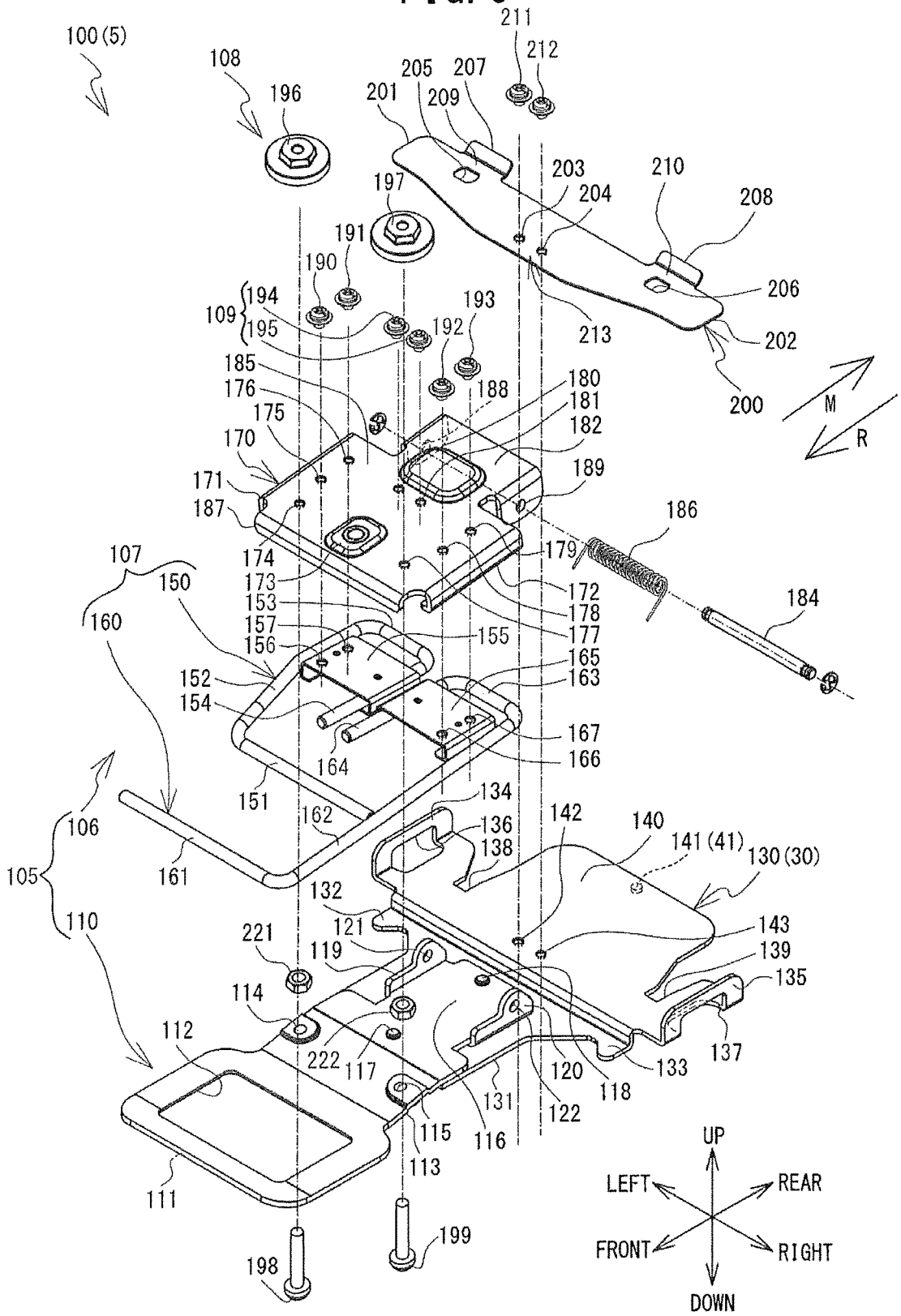
FIG. 6 is an exploded oblique view of the embroidery frame 100.

As shown in FIGS. 2 and 3, the embroidery frame 100 is mainly provided with the holding member 105, an attaching member 130, and a positioning member 200. As shown in FIG. 6, the holding member 105 is provided with a lower holding member 110 and an upper holding member 106. The holding member 105 is able to hold the sewing workpiece by sandwiching the sewing workpiece between the lower holding member 110 and the upper holding member 106 from below and above, respectively.

The lower holding member 110 is a member that is capable of supporting the sewing workpiece from below. The lower holding member 110 is mainly provided with a carrying portion 111, a connecting portion 113, and a support portion 116. The carrying portion 111 is a rectangular frame whose corners are rounded in a plan view, and it includes a rectangular hole 112 whose long axis extends in the left-right direction in a plan view. The top face of the carrying portion 111 is flat, and the sewing workpiece is carried on the top face. As shown in FIGS. 7 and 8, in a case where the embroidery frame 100 is mounted on a frame support mechanism 84, the lower holding member 110, which includes the carrying portion 111, is disposed on a horizontal plane H. The horizontal plane H is a virtual horizontal plane that is located a short distance above the top face of the needle plate 16 (refer to FIG. 1). As shown in FIG. 3, in a case where the embroidery frame 100 is mounted on the frame support mechanism 84 of the sewing machine 1, the sewable area 39 is set inside the hole 112. As shown in FIG. 6, the connecting portion 113 is rectangular in a plan view, and it connects the carrying portion 111 and the support portion 116. A pair of threaded holes 114, 115 that are vertically oriented through-holes are provided in a left portion and a right portion, respectively, of the connecting portion 113. Screws 198, 199 are secured by being screwed into the pair of the threaded holes 114, 115, respectively, from below. Furthermore, nuts 221, 222 are secured by being screwed onto the screws 198, 199, respectively, from above. The nuts 221, 222 are provided for locking the screws 198, 199. Flanges 119, 120 are provided such that they extend upward in a rear portion of the support portion 116. The flanges 119, 120 are formed by bending a left portion and a right portion, respectively, of the support portion 116 upward. The flanges 119, 120 are respectively provided with holes 121, 122 that are through-holes that extend in the left-right direction. The support portion 116 is secured to the attaching member 130 by screws 117, 118, which are screwed into threaded holes that are not shown in the drawings.

The upper holding member 106 is able to press down from above on the sewing workpiece that has been placed on the lower holding member 110. The upper holding member 106 is provided with the support member 170 and a pressing member 107. An attaching portion 182 is provided on the rear side of the support member 170. The attaching portion 182 has an inverted U shape in a rear view, and it has a left-right pair of flanges that extend downward. Holes 188, 189 that are circular in a right side view are formed in the left and right flanges, respectively. The support member 170 is supported by a shaft 184 that passes through the holes 188, 189 and through the holes 121, 122 in the lower holding member 110, such that the support member 170 can pivot on the lower holding member 110. In other words, the upper holding member 106 is supported such that it can pivot on the lower holding member 110. The support member 170 is energized in a direction that moves it away from the lower holding member 110 by an elastic member 186 that is wrapped around the shaft 184. Therefore, the upper holding member 106 is energized by the elastic member 186 in the direction that moves it away from the lower holding member 110. Furthermore, the inside diameters of the holes 188, 189 in the support member 170 and the holes 121, 122 in the lower holding member 110 are all slightly larger than the outside diameter of the shaft 184. Therefore, minute gaps exist between the upper holding member 106 and the shaft 184 and between the lower holding member 110 and the shaft 184. It is therefore possible for a slight tilting of the support member 170 to the left and the right to occur in relation to the lower holding member 110, by the amount of the minute gaps.

A support adjustment portion 185 is provided in the front part of the support member 170. The support adjustment portion 185 is rectangular in a plan view and is provided with a left-right pair of support portions 171, 172. In a front view, the support portion 171 is formed into a hook shape that extends downward in the left part of the support adjustment portion 185. In a front view, the support portion 172 is formed into a hook shape that extends downward in the right part of the support adjustment portion 185. The front edge portion 187 of the support adjustment portion 185 is bent downward. A pressing portion 173 is provided in the front part of the support adjustment portion 185, midway between the left and right sides. When using the first adjustment member 108, which will be described later, to adjust the distance between the pressing member 107 and the lower holding member 110, the user uses his finger to press down on the pressing portion 173 to a suitable degree.

The support adjustment portion 185 is provided with holes 174, 177 that are vertically oriented through-holes. The hole 174 is provided in the left front part of the support adjustment portion 185. A first pressing member 150 extends forward from the front edge of the support member 170, more specifically, from the left front part of the support adjustment portion 185. The screw 198 is inserted through the hole 174 from below. In other words, the lower end of the screw 198 is anchored to the lower holding member 110, and the upper part of the screw 198 passes through the support member 170. A nut 196 is screwed onto the upper end of the screw 198. The position of the nut 196 in the up-down direction can be changed by rotating the nut 196 in relation to the screw 198. Changing the position of the nut 196 in the up-down direction changes the distance between the pressing member 107 (the upper holding member 106) and the lower holding member 110. In the same manner, the hole 177 is provided in the right front part of the support adjustment portion 185. A second pressing member 160 extends forward from the front edge of the support member 170, more specifically, from the right front part of the support adjustment portion 185. The screw 199 is inserted through the hole 177 from below. In other words, the lower end of the screw 199 is anchored to the lower holding member 110, and the upper part of the screw 199 passes through the support member 170. A nut 197 is screwed onto the upper end of the screw 199. The position of the nut 197 in the up-down direction can be changed by rotating the nut 197 in relation to the screw 199. Changing the position of the nut 197 in the up-down direction changes the distance between the pressing member 107 (the upper holding member 106) and the lower holding member 110. The screws 198, 199 and the nuts 196, 197 configure the first adjustment member 108. In a state in which the upper holding member 106 is pressing down from above on the sewing workpiece that has been placed on the lower holding member 110, the first adjustment member 108 is able to adjust the distance between the lower holding member 110 and the upper holding member 106.

Here, as described earlier, slight gaps exist between the upper holding member 106 and the shaft 184 and between the lower holding member 110 and the shaft 184. It is possible for a slight tilting of the support member 170 to the left and the right to occur in relation to the lower holding member 110. In a case where a sewing workpiece whose thickness is not uniform in the left-right direction is held by the embroidery frame 5, it is possible for the embroidery frame 5 to hold the sewing workpiece well by allowing the upper holding member 106 to have an orientation in which it is tilted slightly to the left or right in relation to the lower holding member 110. Therefore, the user may adjust the amount that the first adjustment member 108 is tightened such that the upper holding member 106 has an orientation in which it is tilted slightly to the left or right in relation to the lower holding member 110, in accordance with the thickness of the sewing workpiece. In contrast, in a case where the sewing workpiece has a uniform thickness, the user, by appropriately adjusting the positions of the nuts 196, 197 in the up-down direction, can adjust the amount that the first adjustment member 108 is tightened such that the support member 170, that is, the upper holding member 106, does not tilt to the left or the right in relation to the lower holding member 110.

Specifically, the user adjusts the amount that the first adjustment member 108 is tightened by gripping the nuts 196, 197 with his fingers and rotating them. The adjusting of the amounts of tightening of the nuts 196, 197 adjusts the distance between the pressing member 107 and the lower holding member 110. In a case where the nuts 196, 197 have been tightened, as shown in FIG. 7, the top face of the lower holding member 110 is in contact with pressing portions 151, 161, creating a state in which the sewing workpiece can be held between the lower holding member 110 and the pressing portions 151, 161. At this time, the user can easily tighten the nuts 196, 197 by performing the operation while pressing the pressing portion 173 downward. In a case where the holding member 105 holds a sewing workpiece that is comparatively thick (for example, a shoe), the forces (the pressing forces) that the pressing portions 151, 161 impose on the sewing workpiece can be adjusted by adjusting the amounts of tightening of the nuts 196, 197. When the nuts 196, 197 are loosened, as shown in FIG. 8, a state is created in which the pressing portions 151, 161 move away from the top face of the lower holding member 110. In this state, the sewing workpiece can be removed from the holding member 105, and a different sewing workpiece can be mounted. Note that the upper portions of the nuts 196, 197 have regular hexagonal shapes, as shown in FIGS. 2 and 6. The user can therefore rotate the nuts 196, 197 using a tool such as an open-end wrench, an adjustable wrench, or the like, instead of his fingers.

The support adjustment portion 185 is also provided with holes 175, 176, 178, 179, which are vertically oriented through-holes for securing flat springs 155, 165. The flat springs 155, 165 are each formed from flexible flat spring members, they each have a shape in which a right portion and a left portion are bent into hook shapes. In its left portion, the flat spring 155 is provided with threaded holes 156, 157 that correspond to the holes 175, 176 in the support adjustment portion 185. The flat spring 155 is secured to the bottom face of the support member 170 by the screws 190, 191, which are passed through the holes 175, 176 and screwed into the threaded holes 156, 157. In its right portion, the flat spring 165 is provided with threaded holes 166, 167 that correspond to the holes 178, 179 in the support adjustment portion 185. The flat spring 165 is secured to the bottom face of the support member 170 by screws 192, 193, which are passed through the holes 178, 179 and screwed into the threaded holes 166, 167. The support adjustment portion 185 is also provided with threaded holes 180, 181, which are vertically oriented through-holes. The screw 194 and a screw 195 are screwed into the threaded holes 180, 181, respectively.

Using the first adjustment member 108 (refer to FIG. 7) that was described earlier to adjust the distance between the pressing member 107 and the lower holding member 110 makes it possible for the pressing member 107 to press down from above on the sewing workpiece that has been placed on the top face of the carrying portion 111 of the lower holding member 110. Specifically, the pressing member 107 is provided with the first pressing member 150 and the second pressing member 160, as shown in FIG. 6. The first pressing member 150 and the second pressing member 160 are each formed by bending a round bar that is made from a spring material that can be elastically deformed. The first pressing member 150 is provided with the pressing portion 151, a support portion 152, a bent portion 153, and an adjustment portion 154. In the same manner, the second pressing member 160 is provided with the pressing portion 161, a support portion 162, a bent portion 163, and an adjustment portion 164. The pressing portions 151, 161 are both members that extend toward the front from the front edge portion 187 of the support member 170. Each one of the pressing portions 151, 161 is able to press down from above on the sewing workpiece that has been placed on the top face of the carrying portion 111 of the lower holding member 110. As shown in FIG. 3, at the front end of the support portion 152, the pressing portion 151 is bent counterclockwise approximately 90 degrees in relation to the support portion 152, such that it is positioned to the rear of the rectangular sewable area 39 and extends substantially parallel to the long axis of the sewable area 39. At the front end of the support portion 162, the pressing portion 161 is bent clockwise approximately 90 degrees in relation to the support portion 162, such that it is positioned in front of the rectangular sewable area 39 and extends substantially parallel to the long axis of the sewable area 39. In other words, the pressing portion 151 of the first pressing member 150 and the pressing portion 161 of the second pressing member 160 are able to press down on areas that are located on opposite sides of the sewable area 39.

The support portions 152, 162 extend from the attaching portion 182 side to the front edge portion 187 side of the support member 170. As shown in FIG. 9, the support portion 152 is disposed between the flat spring 155 and the support portion 171 of the support member 170 and is supported by the support portion 171. The front portion of the support portion 152 slopes downward toward the front in a left side view, in contrast to the rear portion of the support portion 152, such that when the pressing portion 161 is in contact with the carrying portion 111, the pressing portion 151 is also in contact with the carrying portion 111. The support portion 162 is disposed between the flat spring 165 and the support portion 172 of the support member 170 and is supported by the support portion 172. As shown in FIG. 6, the bent portion 153 is a portion that, at the rear end of the support portion 152, is bent clockwise approximately 90 degrees in a plan view in relation to the support portion 152. The bent portion 163 is a portion that, at the rear end of the support portion 162, is bent counterclockwise approximately 90 degrees in a plan view in relation to the support portion 162. The adjustment portion 154 is a portion that, at the right end of the bent portion 153, is bent clockwise approximately 90 degrees in a plan view in relation to the bent portion 153, and it is supported by a member that is provided in the right portion of the flat spring 155 and that has a hook shape in a front view. The adjustment portion 164 is a portion that, at the left end of the bent portion 163, is bent counterclockwise approximately 90 degrees in a plan view in relation to the bent portion 163, and it is supported by a member that is provided in the left portion of the flat spring 165 and that has a hook shape in a front view.

In the present embodiment, the slopes of the pressing portion 151 of the first pressing member 150 and the pressing portion 161 of the second pressing member 160 in relation to the carrying portion 111 (the horizontal plane H) can be adjusted individually by a second adjustment member 109, as shown in FIGS. 9 to 11. The pressing portion 151 of the first pressing member 150 and the pressing portion 161 of the second pressing member 160 are inclined in relation to the carrying portion 111 (the horizontal plane H) in the directions in which the pressing portions 151, 161 respectively extend in a front view. In a case where the thickness of the sewing workpiece varies in the left-right direction or the like, at least one of the pressing portion 151 and the pressing portion 161 is adjusted by the second adjustment member 109 in the directions in which it extends in a front view. In the present embodiment, the second adjustment member 109 is provided with the screws 194 and 195. By being screwed into the support member 170, the screws 194 and 195 change the positions of the adjustment portions 154, 164, respectively, in the up-down direction, with the support portions 152, 162 serving as the respective centers of rotation. Using the screws 194 and 195 to change the respective positions of the adjustment portions 154, 164 in the up-down direction makes it possible to adjust the respective slopes of the pressing portions 151, 161 in relation to the carrying portion 111.

In a case where the position of the right portion of the flat spring 155 in the up-down direction is adjusted by adjusting the amount of the tightening of the screw 194 onto the support member 170, the first pressing member 150 pivots around the support portion 152 in a front view, and the adjustment portion 154 moves up and down together with the right portion of the flat spring 155. The adjustment portion 154 and the pressing portion 151 are formed as a single unit, so the inclination of the pressing portion 151 in relation to the support member 170 changes in accordance with the position of the adjustment portion 154 in the up-down direction. Specifically, in a case where the amount of the tightening of the screw 194 onto the support member 170 increases from the state that is shown in FIG. 9, the position of the right end of the pressing portion 151 in the up-down direction moves downward in accordance with the amount of the increase in the amount of the tightening, as shown in FIG. 10.

In the same manner, in a case where the position of the left portion of the flat spring 165 in the up-down direction is adjusted by adjusting the amount of the tightening of the screw 195 onto the support member 170, the second pressing member 160 pivots around the support portion 162 in a front view, and the adjustment portion 164 moves up and down together with the left portion of the flat spring 165. The adjustment portion 164 and the pressing portion 161 are formed as a single unit, so the inclination of the pressing portion 161 in relation to the support member 170 changes in accordance with the position of the adjustment portion 164 in the up-down direction. Specifically, in a case where the amount of the tightening of the screw 195 onto the support member 170 increases from the state that is shown in FIG. 9, the position of the left end of the pressing portion 161 in the up-down direction moves downward in accordance with the amount of the increase in the amount of the tightening, as shown in FIG. 11. In a case where the holding member 105 holds a sewing workpiece that is comparatively thick (for example, a shoe), the forces (the pressing forces) that the pressing portions 151, 161 impose on the sewing workpiece can be adjusted in accordance with their positions in the left-right direction by adjusting the amounts of tightening of the screws 194, 195. The screws 194 and 195 are constantly energized upward by the elastic forces of the flat springs 155, 165. Therefore, the screws 194 and 195 are in a state in which they are held such that they do not loosen.

As shown in FIG. 2, the attaching member 130 is a plate-shaped member that is made of metal, and it is supported by the frame support mechanism 84 of the sewing machine 1 in a specified position that will be described later, such that it can be mounted and removed. As shown in FIG. 6, the attaching member 130 is provided with a connecting portion 131, indicator portions 132, 133, and an attaching portion 140. The connecting portion 131 has a surface that extends horizontally in the front part of the attaching member 130. The support portion 116 of the lower holding member 110 is disposed on the top face of the connecting portion 131, and the attaching member 130 and the lower holding member 110 are connected by the screws 117, 118. The indicator portions 132, 133 are respectively provided in a left portion and a right portion of the rear part of the connecting portion 131, and they are projecting portions that project toward the front. In a case where the sewing workpiece is a shoe, the indicator portions 132, 133 serve as indicators of the position where the sewing workpiece is mounted on the lower holding member 110. The positions in which indicator portions 132, 133 are provided are determined by taking into account whether the sewing workpiece that is held in the embroidery frame 100 will move during the embroidery sewing and interfere with a member with which the sewing machine 1 is provided (for example, the cylinder bed 10 or the left-right pair of the support portions 2).

The attaching portion 140 is a portion that is supported by a frame support member 83 of the sewing machine 1 in such a way that it can be mounted on and removed from the frame support member 83. The attaching portion 140 is formed in the rear part of the attaching member 130. The attaching portion 140 is provided with a left-right pair of insertion portions 134, 135, a left-right pair of guide portions 138, 139, a left-right pair of threaded holes 142, 143, and a projecting portion 141. The insertion portion 134 is formed by bending the left portion of the attaching portion 140 upward, and it includes a hole 136. The insertion portion 135 is formed by bending the right portion of the attaching portion 140 upward, and it includes a hole 137. The guide portions 138, 139 are provided between the insertion portions 134, 135 in the left-right direction. Each one of the guide portions 138, 139 is portion that is notched approximately in a V shape in a plan view. The projecting portion 141 projects downward in the rear part of the attaching portion 140, close to the center in the left-right direction. The position of the projecting portion 141 in the left-right direction in relation to the attaching portion 140 is set in a position that is specific to the embroidery frame 100, in order to distinguish the embroidery frame 100 from the other embroidery frames 5.

The positioning member 200 is a member that defines the specified mounting position for the attaching member 130. In the present embodiment, the specified mounting position is a position where second engaging portions 205, 206, which will be described later, engage with first engaging portions 87, 89, respectively, as shown in FIG. 2. The positioning member 200 is a flexible flat spring member that extends in a direction that intersects a mounting direction M. The mounting direction M is the direction in which the attaching member 130 moves when it is moved to the mounting position. In the present embodiment, the mounting direction M is the direction from the front toward the rear. In the present embodiment, the positioning member 200 has a left-right symmetrical shape that extends in the left-right direction orthogonally to the mounting direction M. Specifically, the positioning member 200 includes grip portions 201, 202, an anchoring portion 213, the second engaging portions 205, 206, and displaceable portions 209, 210.

The grip portions 201, 202 are portions that the user can grip in an operation that moves the displaceable portions 209, 210, respectively, from a first position to a second position. The first position and the second position will be described later. As shown in FIG. 2, the grip portions 201, 202 are inserted into the holes 136, 137 in the attaching member 130. The grip portions 201, 202 are provided on the left end and the right end, respectively, of the positioning member 200, in positions that are comparatively far from the anchoring portion 213. The anchoring portion 213 is provided in the front portion of the positioning member 200, approximately in the center of the longer dimension of the positioning member 200. In the present embodiment, the longer dimension of the positioning member 200 extends in the left-right direction. The anchoring portion 213 is provided with holes 203, 204. The holes 203, 204 are provided in positions that correspond to the threaded holes 142, 143, respectively, in the attaching member 130. In the front portion of the positioning member 200, the center portion in the left-right direction is secured to the attaching member 130 by a screw 211 and a screw 212. The screw 211 is screwed into the threaded hole 142 through the hole 203. The screw 212 is screwed into the threaded hole 143 through the hole 204.

As shown in FIG. 3, the second engaging portions 205, 206 are vertically oriented through-holes that are provided close to the grip portions 201, 202, respectively. Each one of the second engaging portions 205, 206 has an elliptical shape whose long axis is oriented in the left-right direction in a plan view. In a case where the attaching member 130 is moved to the mounting position, as shown in FIG. 2, the second engaging portions 205, 206 respectively engage with the first engaging portions 87, 89, which are provided in the frame support mechanism 84 of the sewing machine 1, and restrict the horizontal movement of the attaching member 130. The displaceable portions 209, 210 are portions that can be moved (displaced) between the first position and the second position, which are at different distances from the attaching member 130. The first position is a position in which the horizontal movement of the attaching member 130 can be restricted by at least one of the combination of the first engaging portion 87 and the second engaging portion 205 and the combination of the first engaging portion 89 and the second engaging portion 206. The second position is a position in which the restricting of the horizontal movement of the attaching member 130 by the at least one of the combination of the first engaging portion 87 and the second engaging portion 205 and the combination of the first engaging portion 89 and the second engaging portion 206 can be undone. The second position is a position that is farther away from the attaching member 130 than is the first position.

In the present embodiment, the first position is a position in which the attaching member 130 is in contact with the displaceable portions 209, 210. In a case where an external force is not acting on the positioning member 200, the displaceable portions 209, 210 are positioned in the first position by the elastic force of the positioning member 200. In the present embodiment, the second position is a position in which the bottom faces of the displaceable portions 209, 210 are one of in contact with and out of contact with and above the top edge faces of the first engaging portions 87, 89, respectively, such that the displaceable portions 209, 210 are separated from the attaching member 130 in the up-down direction. The displaceable portions 209, 210 are portions of the areas around the second engaging portions 205, 206, respectively. The displaceable portions 209, 210 are provided with inclined portions 207, 208 on the rear side of the positioning member 200. As shown in FIGS. 2 and 6, the inclined portions 207, 208 are inclined in the front-rear direction such that they are closer to the attaching member 130 on the sides that are closer to the second engaging portions 205, 206, respectively. The inclined portions 207, 208 are formed by bending the positioning member 200 obliquely upward toward the rear in a right side view. In the process in which the attaching member 130 is moved to the mounting position, the inclined portions 207, 208 guide the first engaging portions 87, 89 toward the second engaging portions 205, 206, respectively. The first engaging portions 87, 89 are pin-shaped, and their tips are in positions that are farther away from the attaching member 130 than is the first position.

Figure 12:
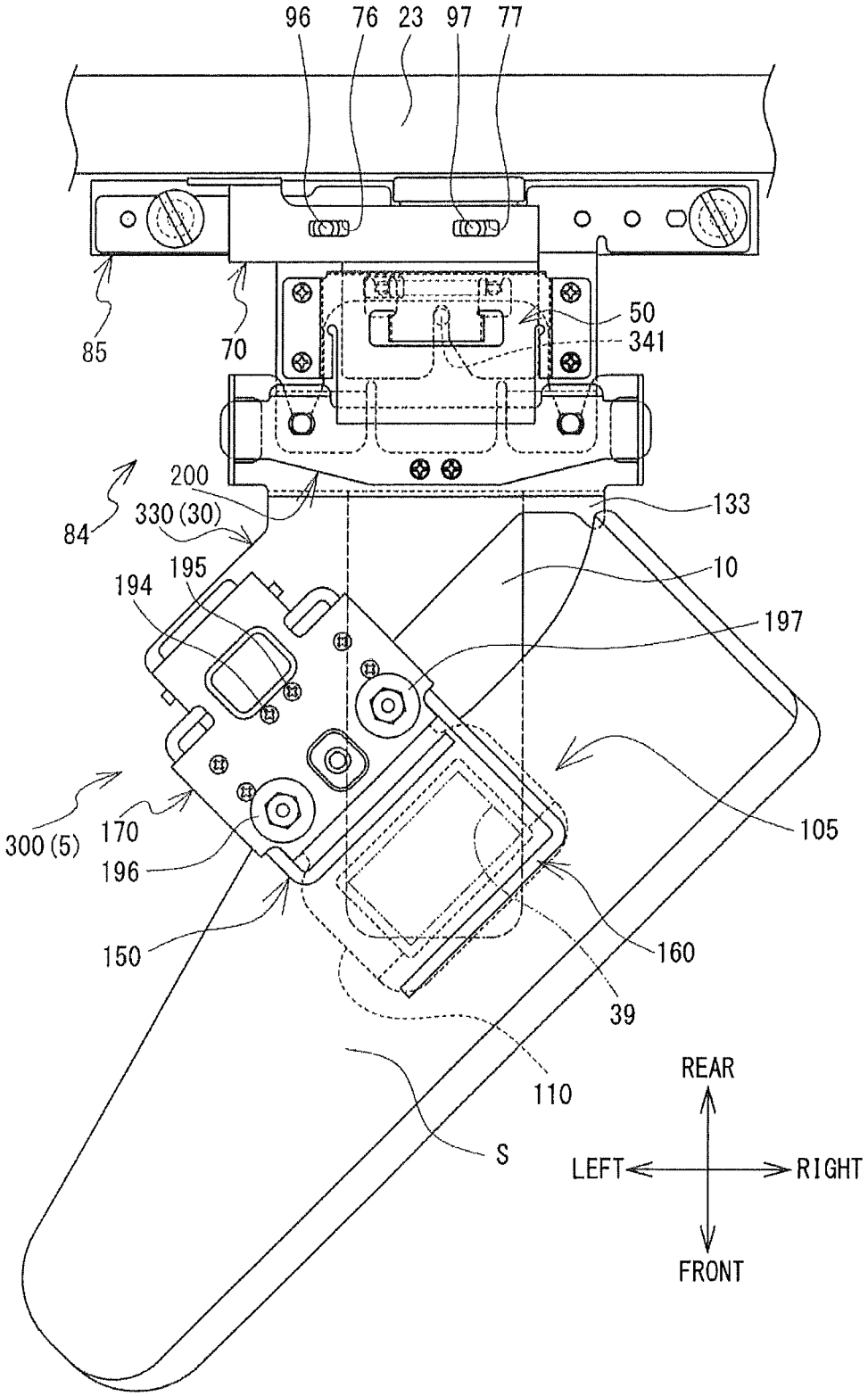
FIG. 12 is a plan view that shows a positional relationship between a shoe S and a cylinder bed 10 in a state in which the embroidery frame 300 is made to hold the shoe S, with a rear edge of an opening in the shoe S aligned with an indicator portion 133 of the embroidery frame 300.

The holding member 105 of the embroidery frame 300 that is shown in FIG. 4 is inclined counterclockwise at an angle of 45 degrees, in a plan view, in relation to the holding member 105 of the embroidery frame 100 that is shown in FIG. 3. In the embroidery frame 300 in FIG. 4, the same reference numerals are assigned to the structural elements that are the same as in the embroidery frame 100, so a detailed explanation will be omitted. The embroidery frame 300 is mainly provided with the holding member 105, an attaching member 330, and the positioning member 200. The holding member 105 and the positioning member 200 in the embroidery frame 300 are the same as the holding member 105 and the positioning member 200 in the embroidery frame 100. The attaching member 330 is a plate-shaped member that is made of metal. As shown in FIG. 12, the attaching member 330 is supported by the frame support mechanism 84 (refer to FIG. 2) of the sewing machine 1 in the same specified position as in the embroidery frame 100, such that it can be mounted and removed. As shown in FIG. 4, the attaching member 330 is provided with a connecting portion 331, the indicator portion 133, and the attaching portion 140. The connecting portion 331 extends horizontally toward the left front in the front portion of the attaching member 330. The support portion 116 of the lower holding member 110 is disposed on the top face of the connecting portion 331, and the attaching member 330 and the lower holding member 110 are connected by screws (not shown in the drawings).

The indicator portion 133 is the same as the indicator portion 133 in the embroidery frame 100, and it is a projecting portion that is provided in the right portion of the rear part of the connecting portion 331 and that projects toward the front. In the present embodiment, in a case where the sewing workpiece is a shoe S, the user causes the embroidery frame 300 to hold the shoe S such that a rear portion of an opening in the shoe S is positioned close to the indicator portion 133, as shown in FIG. 12. In this manner, the shoe S that is held in the embroidery frame 300 does not interfere with the cylinder bed 10 and the support portions 2, even in a case where the embroidery frame 300 is moved by the sewing machine 1 during the embroidery sewing. A projecting portion 341 is provided in the rear part of the attaching portion 140, close to the center in the left-right direction. The projecting portion 341 is pin-shaped and projects downward. The position of the projecting portion 341 in the left-right direction in relation to the attaching portion 140 is set in a position that is specific to the embroidery frame 300, in order to distinguish the embroidery frame 300 from the other embroidery frames 5.

Figure 13:
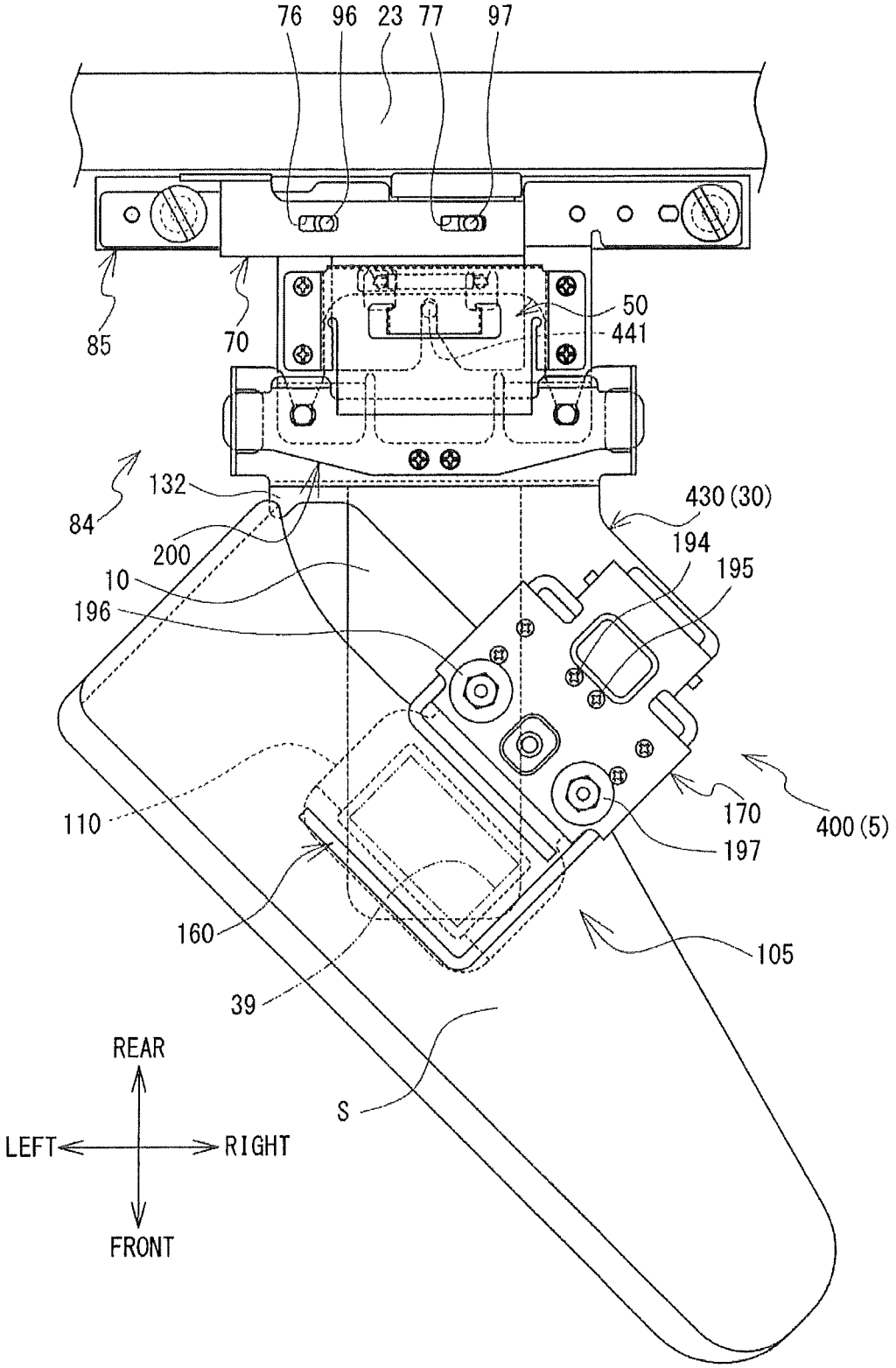
FIG. 13 is a plan view that shows a positional relationship between the shoe S and the cylinder bed 10 in a state in which the embroidery frame 400 is made to hold the shoe S, with the rear edge of the opening in the shoe S aligned with an indicator portion 132 of the embroidery frame 400.

In the same manner, the holding member 105 of the embroidery frame 400 that is shown in FIG. 5 is inclined clockwise at an angle of 45 degrees, in a plan view, in relation to the holding member 105 of the embroidery frame 100 that is shown in FIG. 3. In the embroidery frame 400 in FIG. 5, the same reference numerals are assigned to the structural elements that are the same as in the embroidery frame 100, so a detailed explanation will be omitted. The embroidery frame 400 is mainly provided with the holding member 105, an attaching member 430, and the positioning member 200. The holding member 105 and the positioning member 200 in the embroidery frame 400 are the same as the holding member 105 and the positioning member 200 in the embroidery frame 100. The attaching member 430 is a plate-shaped member that is made of metal. As shown in FIG. 13, the attaching member 430 is supported by the frame support mechanism 84 (refer to FIG. 2) of the sewing machine 1 in the same specified position as in the embroidery frame 100, such that it can be mounted and removed. As shown in FIG. 5, the attaching member 430 is provided with a connecting portion 431, the indicator portion 132, and the attaching portion 140. The connecting portion 431 extends horizontally toward the right front in the front portion of the attaching member 430. The support portion 116 of the lower holding member 110 is disposed on the top face of the connecting portion 431, and the attaching member 430 and the lower holding member 110 are connected by screws (not shown in the drawings).

The indicator portion 132 is a projecting portion that is provided in the left portion of the rear part of the connecting portion 431 and that projects toward the front. In the present embodiment, in a case where the sewing workpiece is the shoe S, the user causes the embroidery frame 400 to hold the shoe S such that the rear portion of the opening in the shoe S is positioned close to the indicator portion 132, as shown in FIG. 13. In this manner, the shoe S that is held in the embroidery frame 400 does not interfere with the cylinder bed 10 and the support portions 2, even in a case where the embroidery frame 400 is moved by the sewing machine 1 during the embroidery sewing. A projecting portion 441 is provided in the rear part of the attaching portion 140, close to the center in the left-right direction. The projecting portion 441 is pin-shaped and projects downward. The position of the projecting portion 441 in the left-right direction in relation to the attaching portion 140 is set in a position that is specific to the embroidery frame 400, in order to distinguish the embroidery frame 400 from the other embroidery frames 5.

Figure 14:
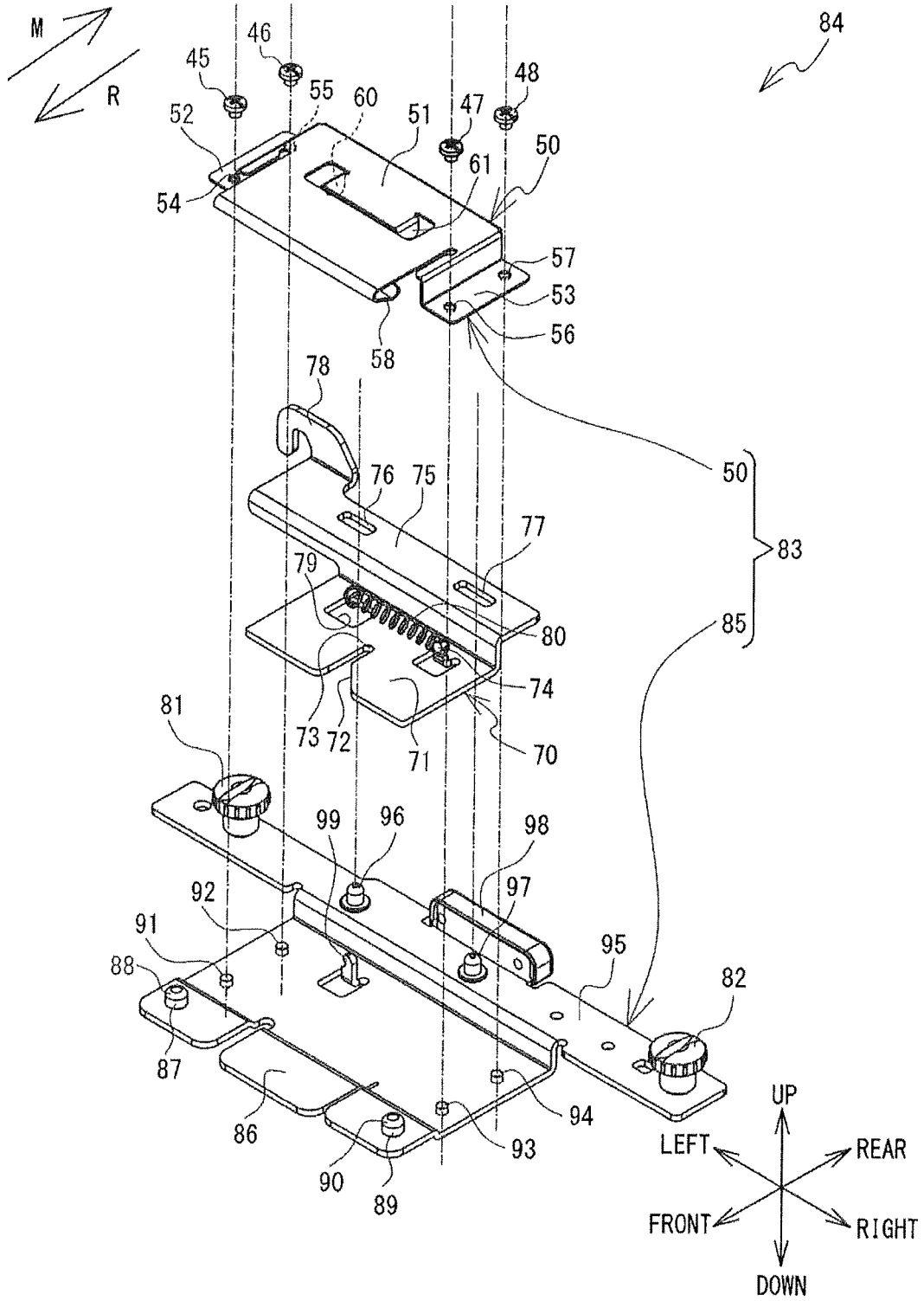
FIG. 14 is an exploded oblique view of the frame support mechanism 84.

The frame support mechanism 84 will be explained with reference to FIGS. 2 and 14. Hereinafter, in a case where the attaching members 130, 330, 430 are referenced collectively, they will be called the attaching members 30, and in a case where a particular attaching member is not specified, it will be called the attaching member 30. In a case where the projecting portion 141, 341, 441 are referenced collectively, they will be called the projecting portions 41, and in a case where a particular projecting portion is not specified, it will be called the projecting portion 41. The frame support mechanism 84 is a mechanism for removably mounting the plurality of the types of the embroidery frame 5 in alternation in the sewing machine 1. As shown in FIG. 14, the frame support mechanism 84 is mainly provided with the frame support member 83 and a switching plate 70.

The embroidery frames 100, 300, and 400 can be mounted in alternation on the frame support member 83. The frame support member 83 is mainly provided with a bottom support member 85 and a frame energizing member 50. The bottom support member 85 is a plate member that extends in the left-right direction, and it is mainly provided with a support plate portion 86, a mounting plate portion 95, and a guide plate portion 98. The support plate portion 86 is a plate-shaped portion that is provided on the front side of the bottom support member 85 such that it extends substantially horizontally. The support plate portion 86 is provided with the first engaging portions 87, 89, a support portion 99, and threaded holes 91 to 94. Screws 45 to 48, which will be described later, are screwed into the threaded holes 91 to 94, respectively. The first engaging portions 87, 89 are pin-shaped projecting portions that are respectively provided in the left front portion and the right front portion of the support plate portion 86 and that project upward. The tips (the upper ends) of the first engaging portions 87, 89 are respectively chamfered portions 88, 90 that are chamfered into smooth hemispherical shapes. In a case where the embroidery frame 5 has been moved to the mounting position, the first engaging portions 87, 89 can respectively engage with the second engaging portions 205, 206 that are provided in the embroidery frame 5. The support portion 99 is a portion that is bent upward from the extending surface of the support plate portion 86. The support portion 99 is inserted through a through-hole 79 in the switching plate 70 and supports a left end of an energizing member 80. In the present embodiment, the energizing member 80 is a coil spring.

The mounting plate portion 95 is a plate-shaped member that is provided such that it extends in the left-right direction. The mounting plate portion 95 is a portion that secures the frame support mechanism 84 to the holder 24 of the X carriage 26 that is shown in FIG. 2, and it also guides the movement of the switching plate 70. The mounting plate portion 95 is provided with a left-right pair of guide pins 96, 97 and a vertically oriented through-hole (not shown in the drawings). The guide pins 96, 97 project upward from the top face of the mounting plate portion 95. The guide pins 96, 97 are respectively inserted into oblong holes 76, 77 in the switching plate 70, and they define the movement direction of the switching plate 70 as the left-right direction. The mounting plate portion 95 is secured to the holder 24 by inserting knob screws 81, 82 through holes and tightening them. The guide plate portion 98 is a plate-shaped portion that is provided such that it extends upward from a central portion of the rear edge of the mounting plate portion 95.

As shown in FIG. 14, the frame energizing member 50 is a flat spring member that energizes the attaching member 30 of the embroidery frame 5 that is mounted on the frame support mechanism 84. The frame energizing member 50 is provided with a body 51, a front pressing portion 58, anchoring portions 52, 53, and center pressing portions 60, 61. The body 51 has a rectangular shape whose long axis extends in the left-right direction in a plan view. The front pressing portion 58 is a portion that is V-shaped in a right side view, and it has a surface that is inclined obliquely downward toward the rear from the front edge of the body 51. In a case where the attaching member 30 is positioned in the mounting position, the front pressing portion 58 is disposed above the attaching member 30 and energizes the attaching member 30 toward bottom support member 85 (downward in the present embodiment). In a case where, with the attaching member 30 in the state of being positioned in the mounting position, the grip portions 201, 202 are operated and the displaceable portions 209, 210 are moved from the first position to the second position, the front pressing portion 58 of the frame energizing member 50 also energizes the positioning member 200 in a removing direction R. The removing direction R is the direction in which the attaching member 30 moves when the attaching member 30 is moved out of the mounting position. In the present embodiment, the removing direction R is the opposite direction from the mounting direction M, so it is the direction from the rear toward the front. The anchoring portions 52, 53 are respectively connected to the left end and the right end of the body 51. The anchoring portion 52 is provided with through-holes 54, 55, which are aligned in the front-rear direction. The anchoring portion 53 is provided with through-holes 56, 57, which are aligned in the front-rear direction. The frame energizing member 50 is secured to the bottom support member 85 by the screws 45 to 48, which are inserted into the through-holes 54 to 57, respectively. The center pressing portions 60, 61 are portions where parts of the central portion of the body 51 are bent downward. The center pressing portions 60, 61 are able to press the attaching member 30 that is positioned in the mounting position toward the bottom support member 85 (downward in the present embodiment) from above.

The switching plate 70 is a moving member that moves to the right in conjunction with the operation by which the attaching member 30 of the embroidery frame 5 is mounted on the frame support member 83, and the amount that switching plate 70 moves is set in accordance with the type of the embroidery frame 5. The switching plate 70 includes a first plate portion 71, a second plate portion 75, and an engaging portion 78. The first plate portion 71 is a plate-shaped portion that is provided on the front side of the switching plate 70 such that it extends horizontally. The first plate portion 71 is disposed above the support plate portion 86 of the bottom support member 85 and below the frame energizing member 50. The first plate portion 71 is provided with a first contact portion 72, a second contact portion 73, a support portion 74, and the through-hole 79. The first contact portion 72 is a portion that is deeply notched into the front edge of the first plate portion 71 in an inverted V shape in a plan view, and it guides the projecting portion 41 of the embroidery frame 5 to the second contact portion 73. The second contact portion 73 is a portion that comes into contact with and holds the projecting portion 41 of the embroidery frame 5 when the embroidery frame 5 is mounted in the sewing machine 1. The support portion 74 is a portion that projects upward from the extending surface of the first plate portion 71, and it supports a right end of the energizing member 80. The switching plate 70 is energized toward the left by the energizing member 80.

The second plate portion 75 is a plate-shaped portion that extends in the left-right direction, and it is provided with the left-right pair of the oblong holes 76, 77. Each one of the oblong holes 76, 77 extends in the left-right direction. The guide pins 96, 97 are respectively inserted into the oblong holes 76, 77. The engaging portion 78 is a hook-shaped portion that is provided such that it extends upward from a left rear edge of the second plate portion 75, and it engages with a detection element 38 (refer to FIG. 2) that is included in a rotary potentiometer (not shown in the drawings). The detection element 38 rotates in accordance with the amount of the movement of the switching plate 70. Therefore, the rotary potentiometer is able to detect the amount of the movement of the switching plate 70 based on the amount of the rotation of the detection element 38. The sewing machine 1 is able to detect the type of the embroidery frame 5 based on the amount of the rotation of the detection element 38 that is detected by the rotary potentiometer.

Figure 15:
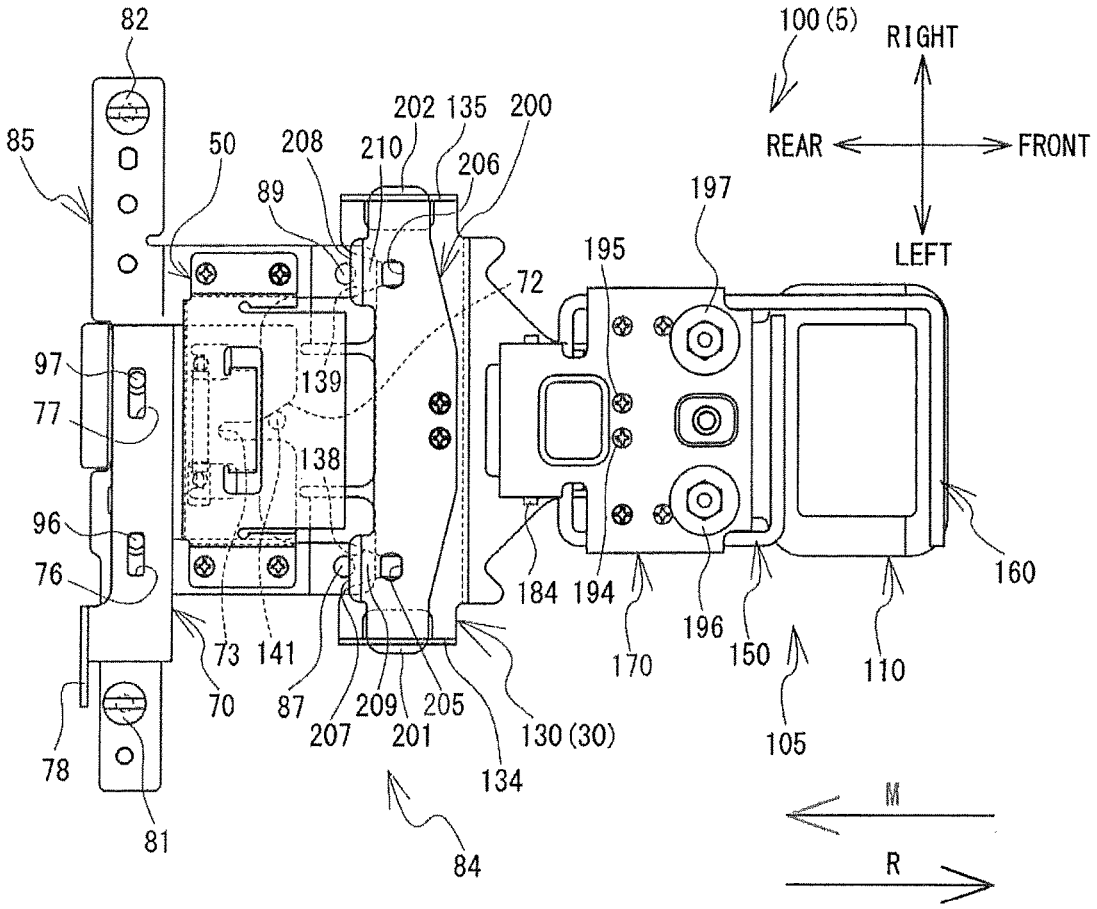
FIG. 15 is a plan view that shows a state in which inclined portions 207, 208 of a positioning member 200 are respectively in contact with first engaging portions 87, 89 of a bottom support member 85, in a process in which the embroidery frame 100 is attached to the frame support mechanism 84.
Figure 16:
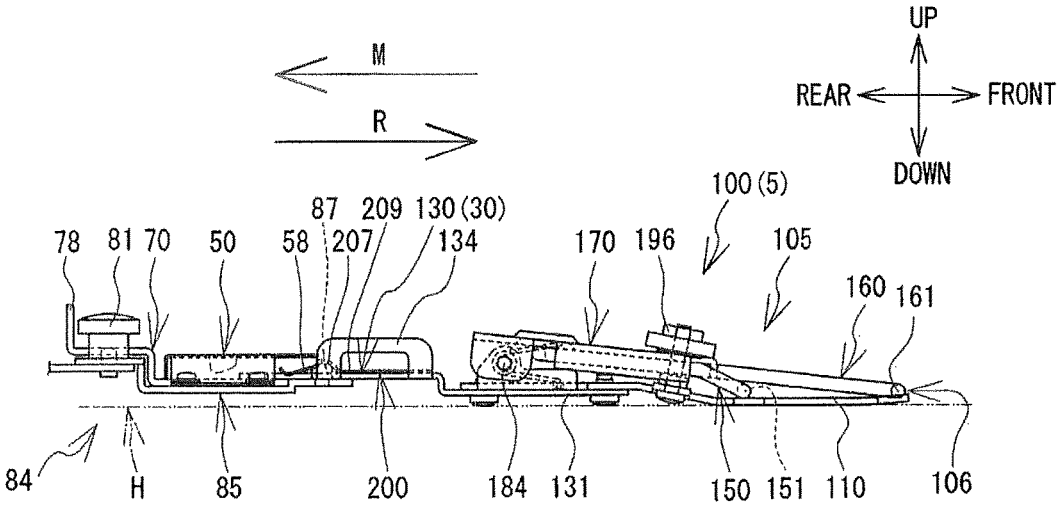
FIG. 16 is a left side view that shows the state in which the inclined portions 207, 208 of the positioning member 200 are respectively in contact with the first engaging portions 87, 89 of the bottom support member 85, in the process in which the embroidery frame 100 is attached to the frame support mechanism 84.
Figure 17:
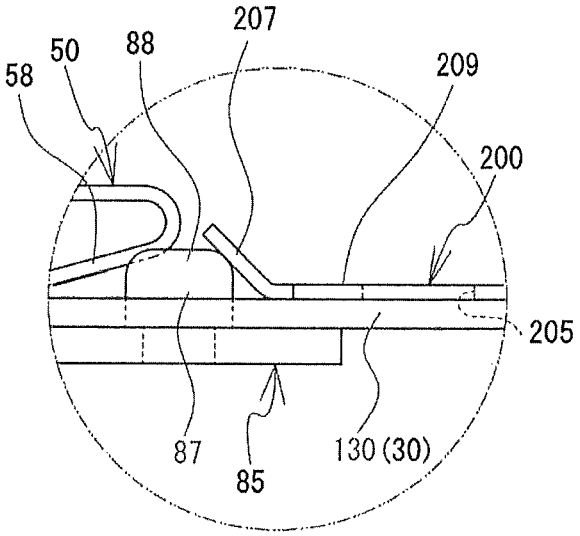
FIG. 17 is an enlarged view of the area where the inclined portion 207 and the first engaging portion 87 of the bottom support member 85 are in contact in FIG. 16.
Figure 18:
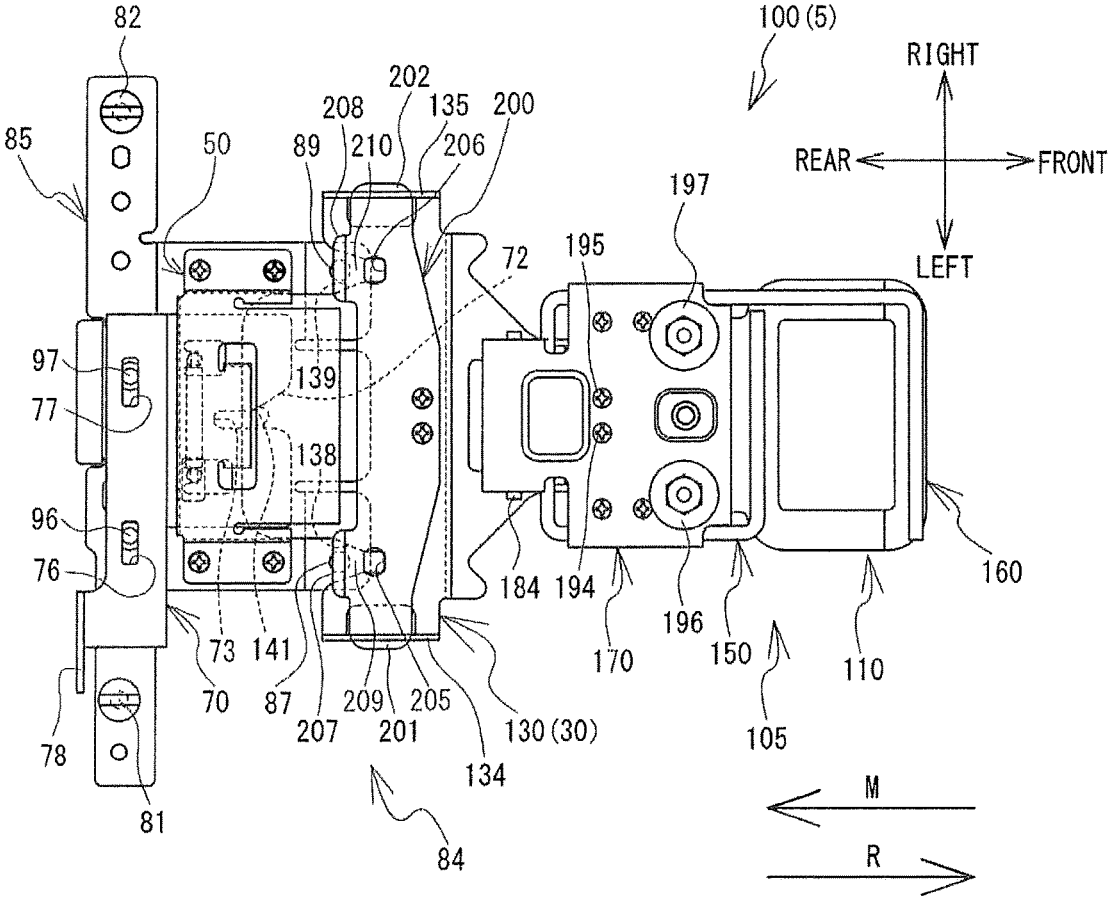
FIG. 18 is a plan view that shows a state in which displaceable portions 209, 210 of the positioning member 200 have been raised to second positions by the first engaging portions 87, 89, respectively, of the bottom support member 85, in the process in which the embroidery frame 100 is attached to the frame support mechanism 84.
Figure 19:
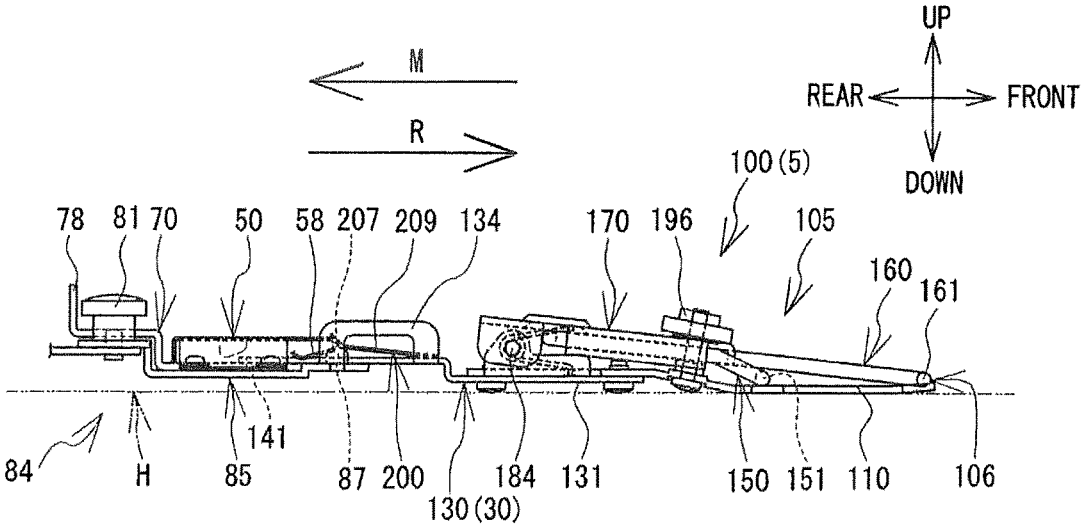
FIG. 19 is a left side view that shows the state in which the displaceable portions 209, 210 of the positioning member 200 have been raised to the second positions by the first engaging portions 87, 89, respectively, of the bottom support member 85, in the process in which the embroidery frame 100 is attached to the frame support mechanism 84.
Figure 20:
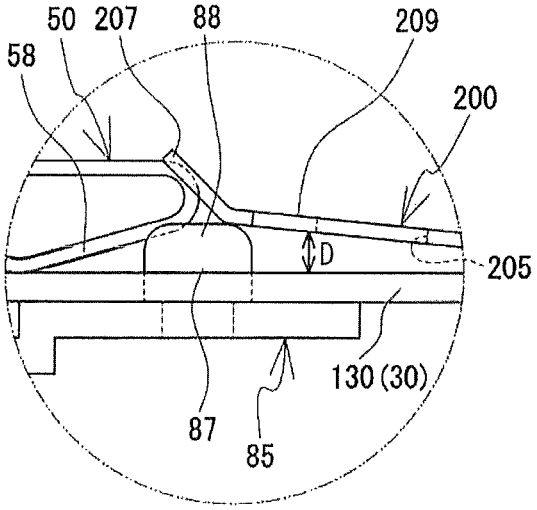
FIG. 20 is an enlarged figure that schematically shows the area where the displaceable portion 209 has been raised to the second position by the first engaging portion 87 of the bottom support member 85 in FIG. 19.

The operation of mounting the embroidery frame 5 in the sewing machine 1 will be explained with reference to FIGS. 7 and 15 to 22. A case in which the user mounts the embroidery frame 100 on the frame support mechanism 84 (the frame support member 83) will be explained as an example. The operations of mounting the embroidery frame 300 and the embroidery frame 400 on the frame support mechanism 84 are the same as the operation of mounting the embroidery frame 100 on the frame support mechanism 84. First, the user moves the embroidery frame 100 horizontally in the mounting direction M until the first engaging portion 87 comes into contact with the inclined portion 207 and the first engaging portion 89 comes into contact with the inclined portion 208, as shown in FIGS. 15 to 17. At this time, the displaceable portions 209, 210 are both in the first position, where they are in contact with the attaching member 130, as shown in FIG. 17. In a case where the printing medium 100 is moved horizontally further in the mounting direction M from the position that is shown in FIGS. 15 to 17, the inclined portion 207 moves upward while remaining in contact with the chamfered portion 88 of the first engaging portion 87, creating a state in which the displaceable portion 209 is lifted up by the first engaging portion 87, as shown in FIGS. 18 to 20. At the same time, the inclined portion 208 moves upward while remaining in contact with the chamfered portion 90 of the first engaging portion 89, creating a state in which the displaceable portion 210 is lifted up by the first engaging portion 89. The displaceable portions 209, 210 are thus lifted up by the first engaging portions 87, 89, respectively, and move to the second position. At this time, the positioning member 200 is put into a state in which the grip portions 201, 202 are flexed upward. As shown in FIG. 20, the displaceable portions 209, 210 have moved upward away from the attaching member 130, their vertical distance from the attaching member 130 being a distance D.

Figure 21:
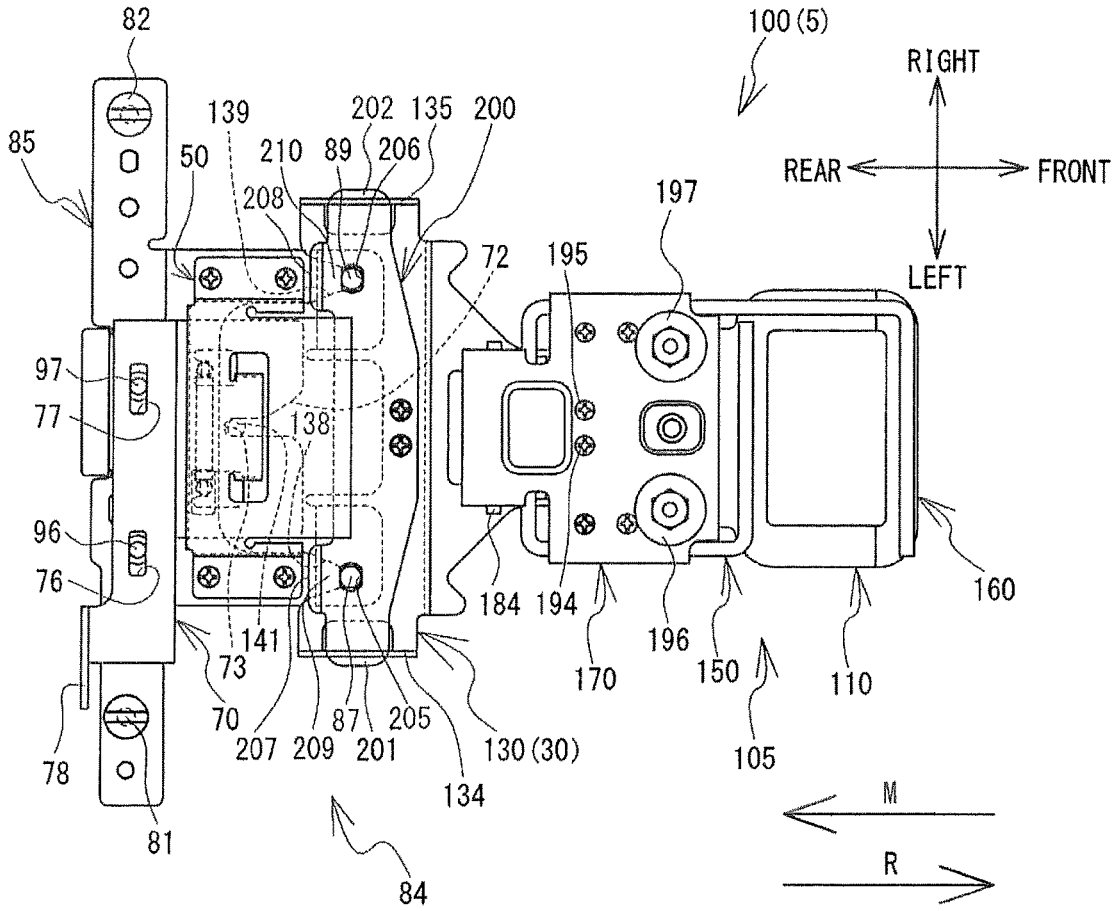
FIG. 21 is a plan view that shows a state in which second engaging portions 205, 206 of the positioning member 200 are respectively engaged with the first engaging portions 87, 89 of the bottom support member 85, in the process in which the embroidery frame 100 is attached to the frame support mechanism 84.
Figure 22:
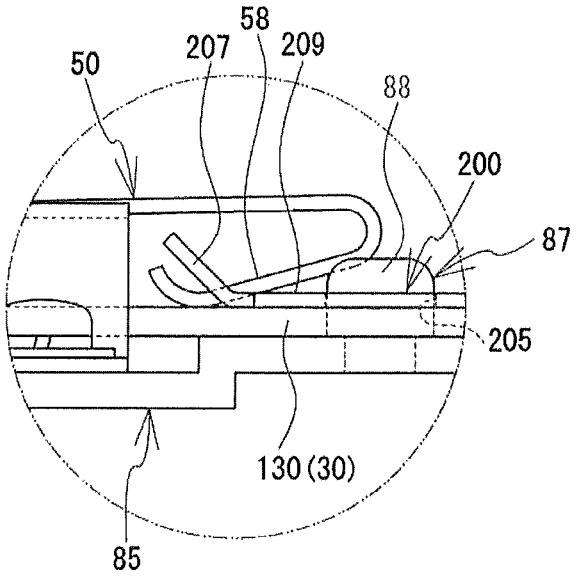
FIG. 22 is an enlarged figure that schematically shows the area where the second engaging portion 205 is engaged with the first engaging portion 87 in FIG. 7.

When the user moves the embroidery frame 100 further in the mounting direction M, the projecting portion 141 is guided by the first contact portion 72 and is placed in the second contact portion 73. At this time, the switching plate 70 moves to the right in accordance with the position of the projecting portion 141 in relation to the attaching portion 140. When the user moves the embroidery frame 100 further horizontally in the mounting direction M, the first engaging portions 87, 89 are reliably guided horizontally to the respective second engaging portions 205, 206 by the respective guide portions 138, 139, and they engage with the respective second engaging portions 205, 206, as shown in FIGS. 21 and 7. The first engaging portions 87, 89 are smoothly guided into the respective second engaging portions 205, 206 by the chamfered portions 88, 90, which have smoothly curved surfaces in the up-down direction, and they engage with the respective second engaging portions 205, 206. At this time, the displaceable portions 209, 210 are moved from the second position to the first position by the elastic force of the positioning member 200 itself, as shown in FIG. 22. The horizontal movement of the first projecting portion 130 is restricted by the engaging of the first engaging portions 87, 89 with the respective second engaging portions 205, 206, and the horizontal position of the embroidery frame 100 is fixed. The attaching member 130 is pressed down from above by the front pressing portion 58 and the center pressing portions 60, 61 of the frame energizing member 50, so the attaching member 130 is held in place between the frame energizing member 50 and the bottom support member 85. The position of the attaching member 130 in the up-down direction is fixed. The embroidery frame 100 is mounted on the frame support mechanism 84 of the sewing machine 1 by the operation that is described above. The sewing machine 1 is able to detect the type of the embroidery frame 5 by using the amount of the rotation of the detection element 38 to detect the amount of the movement of the switching plate 70.

When removing the embroidery frame 100 from the sewing machine 1, the user lifts the grip portions 201, 202 upward. At this time, the user may, for example, place his left and right thumbs on the top faces of the insertion portions 134, 135, respectively, and lift the grip portions 201, 202 with his index fingers. This makes it easier for the user to apply an upward force on the grip portions 201, 202. Because the amount that the embroidery frame 100 can be lifted is restricted by the insertion portions 134, 135, excessive lifting of the grip portions 201, 202 is reliably avoided. When the grip portions 201, 202 are lifted upward, the positioning member 200 flexes, and the displaceable portions 209, 210, which are disposed close to the grip portions 201, 202, respectively, move from the first position to the second position. When the displaceable portions 209, 210 are in the second position, the second engaging portions 205, 206 are positioned higher than the upper ends of the first engaging portions 87, 89, respectively. When the displaceable portions 209, 210 are moved to the second position, rear edge portions in areas that are slightly toward the center from the inclined portions 207, 208 come into contact with the inclined surface of the front pressing portion 58 of the frame energizing member 50. Therefore, a force bears upon the positioning member 200 in the removing direction R from the front pressing portion 58. When the displaceable portions 209, 210 are in the second position, the attaching member 130 is able to move horizontally, so the user is able to smoothly move the embroidery frame 100 horizontally in the removing direction R by taking advantage of the force that bears upon the positioning member 200 in the removing direction R from the front pressing portion 58. In other words, the user is able to remove the embroidery frame 100 from the mounting position easily.

An operation in which the sewing machine 1 forms a stitch in the sewing workpiece that is held in the embroidery frame 5 will be explained with reference to FIG. 1. The embroidery frame 5 that holds the sewing workpiece is supported by the X carriage 26 (refer to FIG. 2) through the frame support mechanism 84 and the holder 24. One of the ten needle bars (not shown in the drawings) is selected by moving the needle bar case 21 to one of the left and the right. The sewing machine 1 moves the embroidery frame 5 to the specified position by conveying the X carriage 26 to one of the left and the right, using the X axis motor (not shown in the drawings) as the drive source, and by conveying the Y carriage 23 toward one of the front and the rear, using the Y axis motor (not shown in the drawings) as the drive source. When a drive shaft (not shown in the drawings) is rotationally driven by a drive shaft motor (not shown in the drawings), the needle bar drive mechanism (not shown in the drawings) and a thread take-up lever drive mechanism (not shown in the drawings) are driven, such that the selected needle bar and the corresponding thread take-up lever 19 are driven up and down. Furthermore, when the shuttle drive mechanism (not shown in the drawings) is driven by the rotation of the drive shaft motor, the shuttle (not shown in the drawings) is rotationally driven. The sewing needle (not shown in the drawings), the thread take-up lever 19, and the shuttle are thus driven in synchronization with one another such that a stitch is formed in the sewing workpiece.

With the embroidery frame 5 and the sewing machine 1 in the embodiment that is described above, the user, by operating the first adjustment member 108 to adjust the distance between the lower holding member 110 and the upper holding member 106 as desired, is able to hold a sewing workpiece whose thickness is not uniform more reliably than it can be held in the known embroidery frame. Specifically, the embroidery frame 5 can adjust the distance between the lower holding member 110 and the pressing member 107 by pivoting the support member 170, using a rear edge that is one edge of the support member 170 as a pivot point. The pressing member 107 of the embroidery frame 5 can use the first pressing member 150 and the second pressing member 160 to individually press down on the sewing workpiece. Even in a case where the thickness of the sewing workpiece is not uniform, the embroidery frame 5 is able to hold the sewing workpiece by the part on which the first pressing member 150 presses and the part on which the second pressing member 160 presses more reliably than the sewing workpiece can be held in the known embroidery frame.

The pressing portions 151, 161 of the embroidery frame 5 are able to hold the sewing workpiece firmly by pressing down the edges of the rectangular sewable area 39 on the long axis of the sewable area 39. The user is able to adjust the distance between the pressing member 107 and the lower holding member 110 by the simple operation of changing the positions of the nuts 196, 197 in the up-down direction in relation to the screws 198, 199 of the embroidery frame 5. That makes it possible for the user to hold a sewing workpiece with a non-uniform thickness more reliably in the embroidery frame 5 than it can be held in the known embroidery frame.

The user is able to adjust the distance between the pressing member 107 and the lower holding member 110 by the simple operation of changing the positions of the nuts 196, 197 in the up-down direction in relation to the screws 198, 199, for the first pressing member 150 and the second pressing member 160, respectively. That makes it possible for the user to hold the sewing workpiece more reliably in the embroidery frame 5 than it can be held in the known embroidery frame, even in a case where the difference in the thickness of the sewing workpiece between the part on which the first pressing member 150 presses and the part on which the second pressing member 160 presses is comparatively large.

With the embroidery frame 5, the orientations of the pressing portions 151, 161 in relation to the carrying portion 111 can be adjusted individually. Therefore, the embroidery frame 5 is able to hold the sewing workpiece more reliably than can the known embroidery frame, even in a case where the thickness of the sewing workpiece is not uniform in the direction in which the pressing portions 151, 161 extend, that is, in the left-right direction of the sewing machine 1. By the simple operation of operating the screws 194 and 195 individually, the user is able to adjust individually the inclinations of the pressing portions 151, 161 in relation to the carrying portion 111.

In a case where the sewing workpiece is a shoe, the embroidery frame 5 is provided with at least one of the indicator portions 132, 133, which serve as indicators of the position where the shoe has been placed. The positions in which indicator portions 132, 133 are provided are determined by taking into account whether they will interfere with a member with which the sewing machine 1 is provided, in a case where the sewing workpiece (the shoe) that is held in the embroidery frame 5 moves during the embroidery sewing. As shown in FIGS. 12 and 13, the user make the embroidery frame 5 hold the sewing workpiece (the shoe) in an appropriate position by using the indicator portions 132, 133 as guide marks. The configuration that is described above makes it possible for the sewing machine 1 to avoid a situation in which, during the embroidery sewing, the sewing workpiece interferes with a member with which the sewing machine 1 is provided (for example, the cylinder bed 10 or the support portions 2), such that an embroidery pattern cannot be sewn properly.

The sewing machine of the present disclosure is not limited to the sewing machine in the embodiment that is described above, and various types of modifications may be made within the scope of the present disclosure. For example, the modifications hereinafter described in paragraphs (A) to (F) may be made as desired.

(A) The configuration of the sewing machine 1 may be modified as desired. The number of the needle bars with which the sewing machine 1 is provided need only be a number that is not less than one. The sewing machine 1 need only enable the mounting of any number of the embroidery frames that is not less than one. The method by which the sewing machine 1 detects the type of the embroidery frame 5 may be modified as desired. It is also acceptable for the sewing machine 1 not to detect the type of the embroidery frame 5.

(B) The configuration of the lower holding member 110 may be modified as desired. The top face of the carrying portion 111 may also be a curved surface. The shape of the hole 112 of the carrying portion 111 may be modified as desired, to an elliptical shape, a circular shape, or the like.

(C) The configuration of the upper holding member 106 may be modified as desired. For example, the support member 170 and the pressing member 107 may be formed as a single unit. The pressing member 107 may be formed as a single member, and its shape may be either the same as the shape of the carrying portion 111 of the lower holding member 110 or a corresponding frame shape. In a case where the pressing member 107 is formed from the first pressing member 150 and the second pressing member 160, the direction in which the pressing portions 151, 161 extend on the horizontal plane H may also be parallel to the short axis of the sewable area 39, for example. In the case where the pressing member 107 is formed from the first pressing member 150 and the second pressing member 160, the first pressing member 150 and the second pressing member 160 may also be able to press on the sewing workpiece while extending in intersecting directions. In the case where the pressing member 107 is formed from the first pressing member 150 and the second pressing member 160, the shapes of the first pressing member 150 and the second pressing member 160 may also be modified as desired, such as into flat members, for example.

(D) The first adjustment member 108 need only be able to adjust the distance between the lower holding member 110 and the upper holding member 106 in the state in which the upper holding member 106 is pressing from above on the sewing workpiece that has been placed on the lower holding member 110. The number of sets of screws and nuts with which the first adjustment member 108 is provided may also be less than two or greater than two. For example, the first adjustment member 108 may be a screw that screws into a threaded hole that is provided in the lower holding member 110. In that case, the screw is inserted from above into a hole that is provided in the upper holding member 106, and then the screw is screwed into the threaded hole in the lower holding member 110. To adjust the distance between the lower holding member 110 and the upper holding member 106, the user need only adjust the amount of tightening of the screw. The first adjustment member 108 may also be a known member that is able to adjust the distance between the lower holding member 110 and the upper holding member 106 in a plurality of stages.

(E) The second adjustment member 109 need only be able to adjust the inclinations of the pressing portions 151, 161 in relation to the carrying portion 111. The number, the shape, and the arrangement of the second adjustment member 109 may be modified as desired in accordance with the configuration of the pressing member 107. It is also acceptable for the second adjustment member 109 to be able to adjust the inclination of only one of the pressing portions 151, 161 in relation to the carrying portion 111. The second adjustment member 109 may be omitted as necessary.

(F) The indicator portions 132, 133 do not need to be projecting portions. For example, the indicator portions 132, 133 may also be recessed portions, and they may also be reference lines or marks that are applied to the surface of the connecting portion 131. The indicator portions 132, 133 may also be omitted. It is also acceptable for a shoe not to be included among the sewing workpieces that the embroidery frame 5 can hold.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame comprising:

a lower holding member that is configured such that a sewing workpiece is placed on the lower holding member;

an upper holding member that is configured to press from above on the sewing workpiece that is placed on the lower holding member, the upper holding member including:

a support member having one edge portion of the support member being pivotally supported by the lower holding member, and a pressing member provided with a first pressing member and a second pressing member configured to press on areas that are located on opposite sides of a rectangular sewable area of the sewing workpiece that is placed on the lower holding member; and a first adjustment mechanism that is configured to adjust a distance between the lower holding member and the upper holding member in a state in which the upper holding member is pressing from above on the sewing workpiece that is placed on the lower holding member, wherein:

the pressing member includes a portion that extends from another edge portion on an opposite side of the support member from the one edge portion and being a member that is configured, by adjusting the distance between the lower holding member and the upper holding member by the first adjustment mechanism to press on the sewing workpiece that is placed on the lower holding member, and the first pressing member and the second pressing member are each rod-shaped members and are each provided with support portions and pressing portions, the support portions being portions that extend from the one edge portion to the other edge portion of the support member and that are supported by the support member, the pressing portions being members that are bent in relation to the support portions, that extend parallel to the long axis of the sewable area and outside of the sewable area, and that are configured to press on the sewing workpiece that is placed on the lower holding member.

2. The embroidery frame according to claim 1, wherein the first adjustment mechanism is provided with a first screw portion and a nut portion, the first screw portion being a screw portion with one end anchored to the lower holding member and another end passing through the support member, the nut portion being a nut portion that is configured to adjust a distance between the pressing member and the lower holding member by being screwed onto the first screw portion.

3. The embroidery frame according to claim 2, further comprising:

another first screw portion and another nut portion, wherein one of the first screw portion and one of the nut portion being provided on a side of the support member where the first pressing member extends from the other edge portion of the support member, and the other of the first screw portion and the other of the nut portion being provided on a side of the support member where the second pressing member extends from the other edge portion of the support member.

4. The embroidery frame according to claim 1, further comprising:

a second adjustment mechanism that is configured to adjust inclinations of the pressing portions in relation to a carrying portion, the carrying portion being a portion that is provided in the lower holding member, with a top face that is flat, and on which the sewing workpiece is placed.

5. The embroidery frame according to claim 4, wherein the second adjustment mechanism is provided with a second screw portion, the second screw portion being a screw portion that is screwed into the support member and that is configured to adjust the inclinations of the pressing portions in relation to the carrying portion by rotating the pressing portions around the support portions.

6. The embroidery frame according to claim 1, further comprising:

an indicator portion that, in a case where the sewing workpiece is a shoe, serve as indicators of the position where the shoe is placed on the lower holding member.

7. A sewing machine comprising:

an embroidery frame that is provided with a lower holding member that is configured such that a sewing workpiece is placed on the lower holding member;

an upper holding member that is configured to press from above on the sewing workpiece that is placed on the lower holding member, the upper holding member including:

a support member having one edge portion of the support member being pivotally supported by the lower holding member, and a pressing member provided with a first pressing member and a second pressing member configured to press on areas located on opposite sides of a rectangular sewable area of the sewing workpiece that is placed on the lower holding member; and a first adjustment mechanism that is configured to adjust a distance between the lower holding member and the upper holding member in a state in which the upper holding member is pressing from above on the sewing workpiece that is placed on the lower holding member, wherein:

the pressing member includes a portion that extends from another edge portion on an opposite side of the support member from the one edge portion and being a member that is configured, by the adjusting of the distance between the lower holding member and the upper holding member by the first adjustment mechanism, to press on the sewing workpiece that is placed on the lower holding member, and the first pressing member and the second pressing member are each rod-shaped members and are each provided with support portions and pressing portions, the support portions being portions that extend from the one edge portion to the other edge portion of the support member and that are supported by the support member, the pressing portions being members that are bent in relation to the support portions, that extend parallel to the long axis of the sewable area and outside of the sewable area, and that are configured to press on the sewing workpiece that is placed on the lower holding member.

8. The sewing machine according to claim 7, wherein the first adjustment mechanism is provided with a first screw portion and a nut portion, the first screw portion being a screw portion with one end anchored to the lower holding member and another end passing through the support member, the nut portion being a nut portion that is configured to adjust a distance between the pressing member and the lower holding member by being screwed onto the first screw portion.

9. The sewing machine according to claim 8, further comprising:

another first screw portion and another nut portion, wherein one of the first screw portion and one of the nut portion being provided on a side of the support member where the first pressing member extends from the other edge portion of the support member, the other of the first screw portion and the other of the nut portion being provided on a side of the support member where the second pressing member extends from the other edge portion of the support member.

10. The sewing machine according to claim 7, wherein the embroidery frame is further provided with a second adjustment mechanism that is configured to adjust inclinations of the pressing portions in relation to a carrying portion, the carrying portion being a portion that is provided in the lower holding member, with a top face that is flat, and on which the sewing workpiece is placed.

11. The sewing machine according to claim 10, wherein the second adjustment mechanism is provided with a second screw portion, the second screw portion being a screw portion that is screwed into the support member and that is configured to adjust the inclinations of the pressing portions in relation to the carrying portion by rotating the pressing portions around the support portions.

12. The sewing machine according to claim 7, wherein the embroidery frame is further provided with an indicator portion that, in a case where the sewing workpiece is a shoe, serve as indicators of the position where the shoe is placed on the lower holding member.

13. An embroidery frame comprising:

a lower holding member that is configured such that a sewing workpiece is placed on the lower holding member;

an upper holding member that is configured to press from above on the sewing workpiece that is placed on the lower holding member, the upper holding member including:

a support member having one edge portion of the support member being pivotally supported by the lower holding member, and a pressing member provided with a first pressing member and a second pressing member configured to press on areas that are located on opposite sides of a rectangular sewable area of the sewing workpiece that is placed on the lower holding member; and a first adjustment mechanism that is configured to adjust a distance between the lower holding member and the upper holding member in a state in which the upper holding member is pressing from above on the sewing workpiece that is placed on the lower holding member, wherein:

the pressing member includes a portion that extends from another edge portion on an opposite side of the support member from the one edge portion and being a member that is configured, by adjusting the distance between the lower holding member and the upper holding member by the first adjustment mechanism, to press on the sewing workpiece that is placed on the lower holding member, and the first adjustment mechanism is provided with a first screw portion and a nut portion, the first screw portion being a screw portion with one end anchored to the lower holding member and another end passing through the support member, the nut portion being a nut portion that is configured to adjust a distance between the pressing member and the lower holding member by being screwed onto the first screw portion.

14. The embroidery frame according to claim 13, wherein the first pressing member and the second pressing member are each rod-shaped members and are each provided with support portions and pressing portions, the support portions being portions that extend from the one edge portion to the other edge portion of the support member and that are supported by the support member, the pressing portions being members that are bent in relation to the support portions, that extend parallel to the long axis of the sewable area and outside of the sewable area, and that are configured to press on the sewing workpiece that is placed on the lower holding member.

15. The embroidery frame according to claim 13, further comprising:

another first screw portion and another nut portion, wherein one of the first screw portion and one of the nut portion being provided on a side of the support member where the first pressing member extends from the other edge portion of the support member, and the other of the first screw portion and the other of the nut portion being provided on a side of the support member where the second pressing member extends from the other edge portion of the support member.

16. The embroidery frame according to claim 14, further comprising:

a second adjustment mechanism that is configured to adjust inclinations of the pressing portions in relation to a carrying portion, the carrying portion being a portion that is provided in the lower holding member, with a top face that is flat, and on which the sewing workpiece is placed.

17. The embroidery frame according to claim 16, wherein the second adjustment mechanism is provided with a second screw portion, the second screw portion being a screw portion that is screwed into the support member and that is configured to adjust the inclinations of the pressing portions in relation to the carrying portion by rotating the pressing portions around the support portions.

18. The embroidery frame according to claim 13, further comprising:

an indicator portion that, in a case where the sewing workpiece is a shoe, serve as indicators of the position where the shoe is placed on the lower holding member.

19. A sewing machine comprising:

an embroidery frame that is provided with a lower holding member that is configured such that a sewing workpiece is placed on the lower holding member;

an upper holding member that is configured to press from above on the sewing workpiece that is placed on the lower holding member, the upper holding member including:

a support member having one edge portion of the support member being pivotally supported by the lower holding member, and a pressing member provided with a first pressing member and a second pressing member configured to press on areas located on opposite sides of a rectangular sewable area of the sewing workpiece that is placed on the lower holding member; and a first adjustment mechanism that is configured to adjust a distance between the lower holding member and the upper holding member in a state in which the upper holding member is pressing from above on the sewing workpiece that is placed on the lower holding member, wherein:

the pressing member includes a portion that extends from another edge portion on an opposite side of the support member from the one edge portion and being a member that is configured, by the adjusting of the distance between the lower holding member and the upper holding member by the first adjustment mechanism, to press on the sewing workpiece that is placed on the lower holding member, and the first adjustment mechanism is provided with a first screw portion and a nut portion, the first screw portion being a screw portion with one end anchored to the lower holding member and another end passing through the support member, and the nut portion being a nut portion configured to adjust a distance between the pressing member and the lower holding member by being screwed onto the first screw portion.

20. The sewing machine according to claim 19, wherein the first pressing member and the second pressing member are each rod-shaped members and are each provided with support portions and pressing portions, the support portions being portions that extend from the one edge portion to the other edge portion of the support member and that are supported by the support member, the pressing portions being members that are bent in relation to the support portions, that extend parallel to the long axis of the sewable area and outside of the sewable area, and that are configured to press on the sewing workpiece that is placed on the lower holding member.

21. The sewing machine according to claim 19, further comprising:

another first screw portion and another nut portion, wherein one of the first screw portion and one of the nut portion being provided on a side of the support member where the first pressing member extends from the other edge portion of the support member, the other of the first screw portion and the other of the nut portion being provided on a side of the support member where the second pressing member extends from the other edge portion of the support member.

22. The sewing machine according to claim 20, wherein the embroidery frame is further provided with a second adjustment mechanism that is configured to adjust inclinations of the pressing portions in relation to a carrying portion, the carrying portion being a portion that is provided in the lower holding member, with a top face that is flat, and on which the sewing workpiece is placed.

23. The sewing machine according to claim 22, wherein the second adjustment mechanism is provided with a second screw portion, the second screw portion being a screw portion that is screwed into the support member and that is configured to adjust the inclinations of the pressing portions in relation to the carrying portion by rotating the pressing portions around the support portions.

24. The sewing machine according to claim 19, wherein the embroidery frame is further provided with an indicator portion that, in a case where the sewing workpiece is a shoe, serve as indicators of the position where the shoe is placed on the lower holding member.

* * * * *